US008523007B2

(12) United States Patent
Miller

(10) Patent No.: US 8,523,007 B2
(45) **Date of Patent: *Sep. 3, 2013**

(54) REINFORCED DUST PAN AND REFUSE CONTAINER

(75) Inventor: David H. Miller, Satellite Beach, FL (US)

(73) Assignee: Xtreme Plastics, LLC, Warren, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,570

(22) Filed: Mar. 5, 2012

(65) Prior Publication Data

US 2012/0228314 A1 Sep. 13, 2012

Related U.S. Application Data

(60) Continuation of application No. 12/344,014, filed on Dec. 24, 2008, now Pat. No. 8,152,019, which is a continuation-in-part of application No. 11/522,212, filed on Sep. 15, 2006, now Pat. No. 7,469,798, which is a division of application No. 10/646,480, filed on Aug. 23, 2003, now Pat. No. 7,185,783.

(60) Provisional application No. 60/405,452, filed on Aug. 23, 2002.

(51) Int. Cl.

| | |
|---|---|
| ***B65D 6/00*** | (2006.01) |
| ***B65D 8/04*** | (2006.01) |
| ***B65D 8/08*** | (2006.01) |
| ***B65D 8/18*** | (2006.01) |

(52) U.S. Cl.
USPC ..... 220/675; 220/643; 220/908.1; 15/257.1

(58) Field of Classification Search
USPC ..... 220/642, 643, 675, 732, 908.3; 15/257.1, 15/257.9; 141/390, 391
See application file for complete search history.

(56) References Cited

U.S. PATENT DOCUMENTS

| | | | | |
|---|---|---|---|---|
| 341,175 | A | 5/1886 | Shaw | |
| 686,954 | A | 11/1901 | Riley | |
| 1,170,797 | A | 2/1916 | Burroughs | |
| 1,174,336 | A | 3/1916 | Menzies | |
| 1,212,305 | A * | 1/1917 | Worsell | 294/178 |

(Continued)

OTHER PUBLICATIONS

OA dated Apr. 6, 2012 for U.S. Appl. No. 12/691,272, 19 pages.

(Continued)

*Primary Examiner* — Harry Grosso
(74) *Attorney, Agent, or Firm* — Turocy & Watson, LLP; Francis L. Dunn, Jr.

(57) ABSTRACT

Snapable narrow width rectangular dust pan that can clip about a flat side outer edge of the open end of a refuse container having curved or flat side open rim edges. The dust pan can be used for converting a refuse container into a dust pan refuse container. The receptacle can include an open upper end with a D-shaped configuration and a closed bottom end with a substantially circular bottom configuration. The receptacle can have a generally cylindrical shape and a flat side wall having a triangular tubular shape for allowing the receptacle to be laid on its side so that rakes and brooms can move debris into the D-shaped opening. At least one handle located on the apex of the D-shaped opening allows the container to be lifted to a vertical standing position, and curved interior wall surfaces allow debris to slide toward the bottom of the container.

20 Claims, 23 Drawing Sheets

(56) References Cited

U.S. PATENT DOCUMENTS

| | | | | |
|---|---|---|---|---|
| 1,748,336 | A | 2/1930 | Finnell | |
| 1,847,476 | A | 3/1932 | Fuhr | |
| 2,812,784 | A | 11/1957 | Palmer | |
| 2,914,787 | A | 12/1959 | Hartkopf | |
| 3,121,248 | A | 2/1964 | Ferguson | |
| 3,170,183 | A | 2/1965 | Leatherman | |
| 3,390,804 | A | 7/1968 | Morgan | |
| 4,312,531 | A | 1/1982 | Cross | |
| 4,600,113 | A | 7/1986 | Demars | |
| 4,659,045 | A | 4/1987 | Flynn | |
| 4,802,258 | A | 2/1989 | Jensen | |
| D309,401 | S | 7/1990 | Lombardi | |
| 5,088,531 | A | 2/1992 | Wade | |
| 5,092,463 | A | 3/1992 | Dees | |
| D345,837 | S | 4/1994 | Bean | |
| D351,699 | S | 10/1994 | Temple et al. | |
| D351,705 | S | 10/1994 | Bird et al. | |
| D355,514 | S | 2/1995 | Breen | |
| 5,502,871 | A | 4/1996 | Reyes | |
| 5,513,822 | A | 5/1996 | Gould | |
| 5,547,104 | A | 8/1996 | Parker | |
| D376,235 | S | 12/1996 | Persnell | |
| 5,758,888 | A | 6/1998 | Burgan et al. | |
| 5,785,369 | A | 7/1998 | Ridley, Sr. et al. | |
| 6,318,588 | B1 | 11/2001 | Lichtenwalner | |
| 6,390,495 | B1 | 5/2002 | Cates | |
| D537,597 | S | 2/2007 | Bolden | |
| 7,185,783 | B1 | 3/2007 | Miller | |
| 7,192,037 | B1 | 3/2007 | Pena | |
| 7,469,798 | B1 | 12/2008 | Miller | |
| 8,152,019 | B1 * | 4/2012 | Miller | 220/675 |
| 2007/0151065 | A1 * | 7/2007 | Monahan et al. | 15/257.7 |

OTHER PUBLICATIONS

U.S. Appl. No. 60/996,334,10 pages.
U.S. Appl. No. 60/996,335, 14 pages.
U.S. Appl. No. 12/344,014, 56 pages.
OA dated Jul. 13, 2011 for U.S. Appl. No. 12/344,014, 9 pages.
OA dated Mar. 30, 2011 for U.S. Appl. No. 12/344,014, 7 pages.
OA due Dec. 15, 2010 for U.S. Appl. No. 12/344,014, 4 pages.
Office Action dated Oct. 26, 2012 for U.S. Appl. No. 12/691,272, 24 pages.
Office Action dated Jan. 3, 2013 for U.S. Appl. No. 12/691,272, 20 pages.

* cited by examiner

Fig. 19B
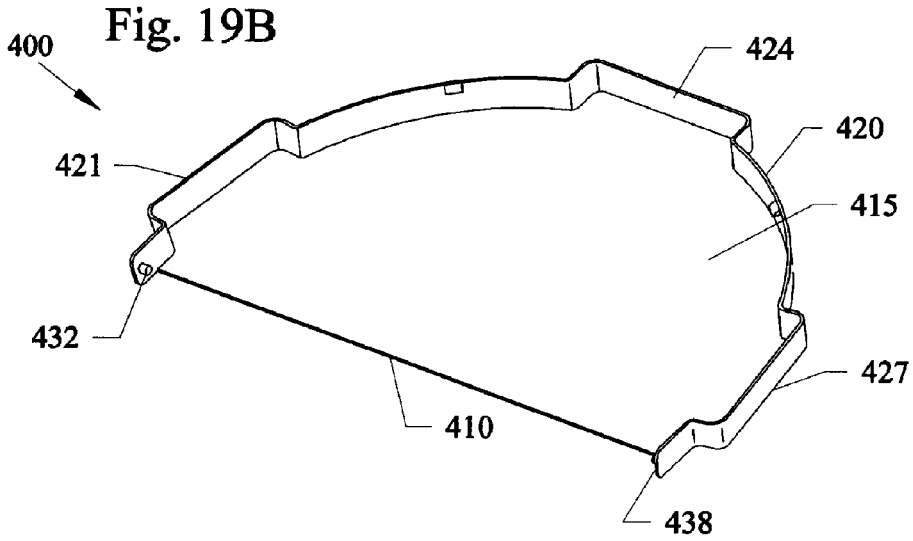
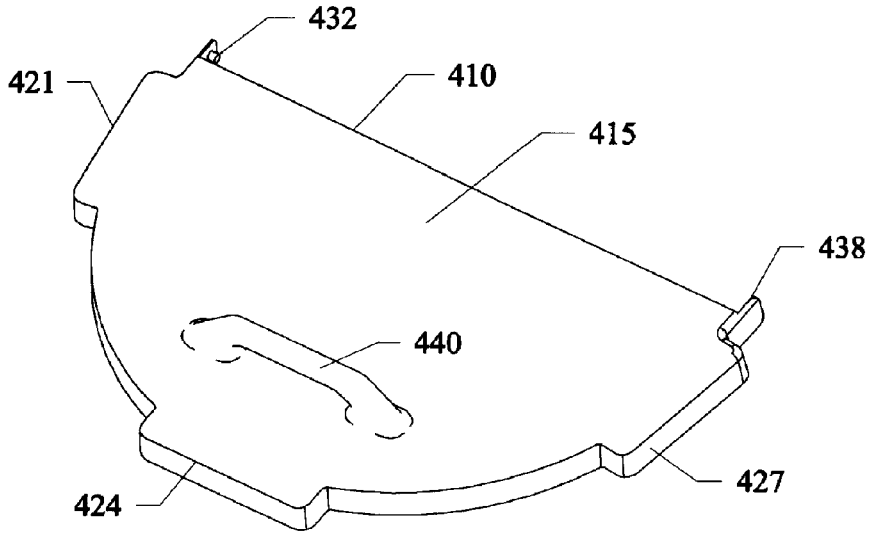
Fig. 19A

Fig. 22B
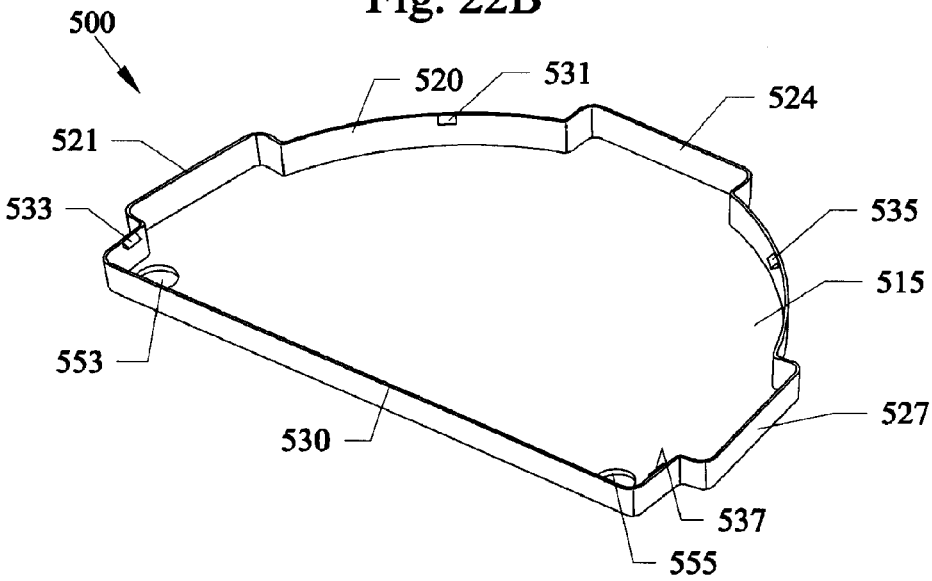
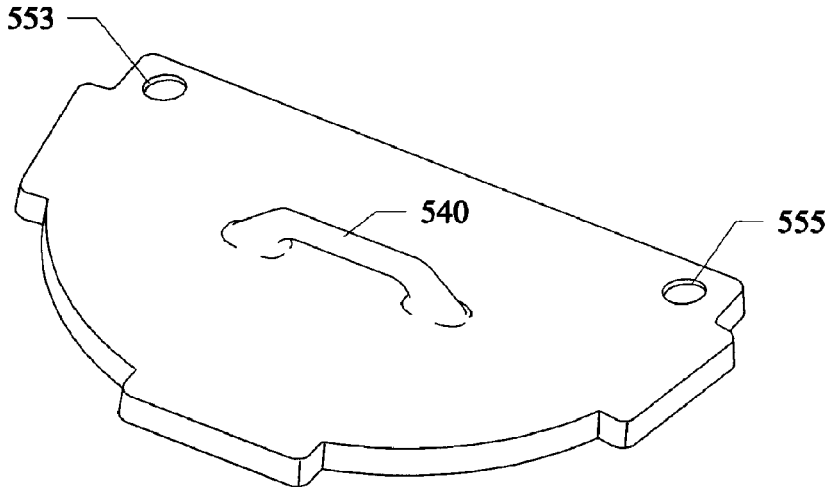
Fig. 22A

Fig. 25
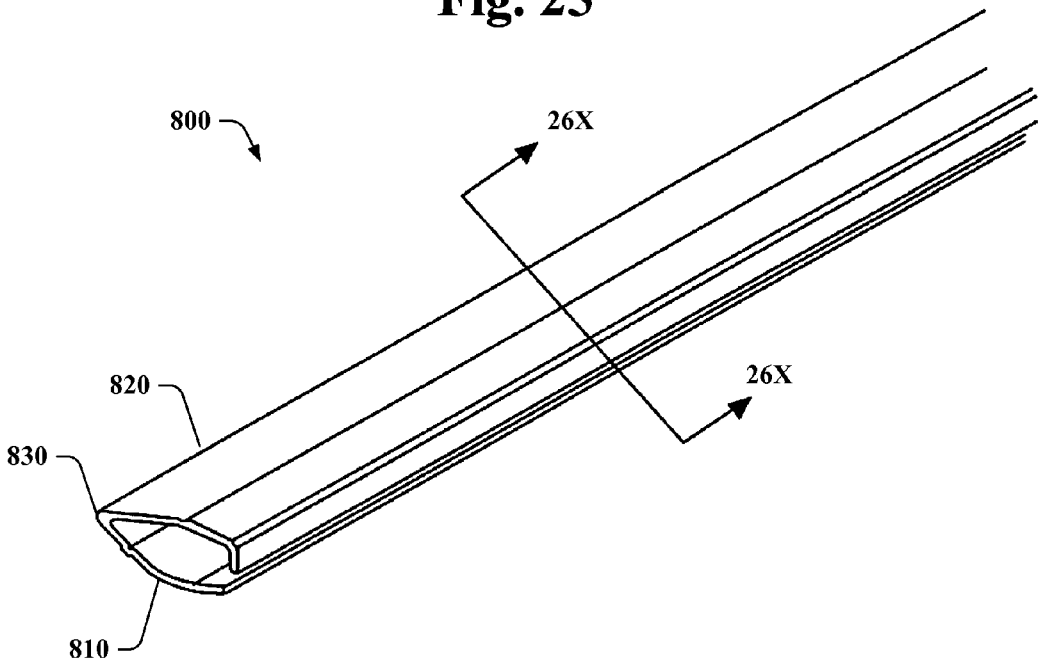
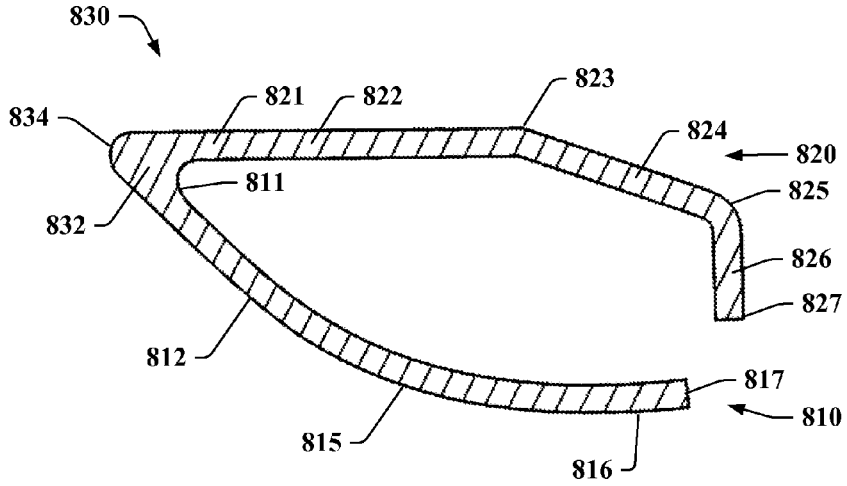
Fig. 26

REINFORCED DUST PAN AND REFUSE CONTAINER

CROSS-REFERENCE TO RELATED APPLICATIONS

This application is a continuation of U.S. patent application Ser. No. 12/344,014, filed Dec. 24, 2008, and entitled REINFORCED DUST PAN AND REFUSE CONTAINER which is a continuation-in-part of U.S. patent application Ser. No. 11/522,212, filed Sep. 15, 2006 now issued as U.S. Pat. No. 7,469,798, which is a divisional application of U.S. patent application Ser. No. 10/646,480 filed Aug. 23, 2003, now issued as U.S. Pat. No. 7,185,783, which claims the benefit of priority to U.S. Provisional Application Ser. No. 60/405,452 filed Aug. 23, 2002,the entirely of each of the aforementioned applications is hereby incorporated herein by reference.

FIELD OF INVENTION

This invention relates to refuse containers and accessories, and in particular to novel refuse containers, accessories, devices, apparatus, systems and methods of attachment and use where the container can be easily laid on flat side portions so that debris can be completely swept inside the container, and remain stable and sturdy when full and standing upright, and accessories, devices, apparatus, systems and methods for allowing refuse receptacles to use reinforced attachable and detachable dust pan devices, apparatus, systems and methods of attaching and using the dust pans.

BACKGROUND AND PRIOR ART

It is common to use refuse containers such as plastic tubular cans for holding outdoor refuse such as leaves, branches, garbage, and the like. Typically, these containers must be kept in an upright standing position to be used. However, the upright standing position generally requires the user having to physically bend and pickup the refuse with one's hands to place it into the standing container. In addition to the undesirable physical movements, it is usually undesirable to physically touch the refuse even if one uses gloves. Furthermore, physically lifting up and moving the refuse usually results in some debris dropping out and having to be picked up again. Users have also been known to try and lay the tubular containers on their sides. However, the circular opening to the container makes it difficult and near impossible to sweep, rake, and move the refuse into the container. Users have also tried to place their body weight with a foot or hand on the upper facing side of the container to squash/reshape the container. However, the circular opening is not meant to bend, and also, the user can slip, fall and get hurt trying to stand on the sides of a plastic container.

Over the years various types of containers have been proposed for storing waste that is different from tubular containers. See for example, U.S. Pat. No. 341,175 to Shaw; U.S.Pat.No. 6,86,954 to Riley; U.S. Pat. No. 1,212,305 to Worsell; U.S. Pat. No. 1,170,797 to Burroughs; U.S.Pat.No. 1,847,476 to Fuhr; U.S. Pat. No. 3,170,183 to Leatherman; U.S. Pat. No. 3,390,804 to Morgan; U.S. Pat. No. 5,088,531 to Wade; U.S. Pat. No. 5,758,888 to Burgan et al.; U.S. Pat. No. 5,785,369 to Ridley et al.; U.S. Pat. No. 6,318,588 to Lichtenwalner; U.S. Pat. No. 6,390,495 to Cates; and Des. U.S. Pat.No. 376,325 to Presnell.

Shaw '175, Riley '954, Worsell '305, Burroughs '797, and Morgan '804 each show containers having substantially D-shaped outer wall shapes for handling debris. However, these containers have open ends with often larger interior diameter sized spacing than their closed ends, which makes the containers difficult if not impossible to stand on their closed bottom ends. Furthermore, filling these containers with debris can create an unstable container since the interior weight is concentrated toward the upper open ends and would tend to cause the containers to fall over spilling their contents out. These containers also do not have reinforced wall designs on the flat side, nor complex curves at the base specifically designed for strengthening debris holding wall so as to maintain the integrity while in use. Furthermore, all of these containers must be physically lifted and carried to be moved which makes them difficult when filled to be mobile. In addition, Riley, 954, Burroughs '797 and Morgan '804 has pivotal lids that would have to be physically removed in order to effectively push debris into those containers.

Leatherman '183, Fuhr '476, Wade '531, Lichtenwalner '588 and Cates '495 each describe debris container having side walls forming rectangular shapes that also have their open ends be larger in interior cross-section than their closed bottom interior ends so that filling up the containers causes a stability problem when trying to vertically stand the container up since more weight is adjacent the upper open end than the closed end. These containers would also tend to fall over and spill their contents out during use.

Presnell '235 and Burgan '888 describe cylindrical containers having rectangular flat side walls, and similar to Lichtenwalner '588 have larger sized upper open ends than the closed bottom ends. The containers can also not be very stable when filled with debris and can easily tip over and spill the container contents when being used. Further, Presnell '235 and Burgan '888 only have handles on left and right sides of the containers which make it difficult to lift from horizontal to standing positions and vice versa. These handles are not specifically designed to lower or raise can from a horizontal position, only for transport in an upright position. Also, both containers have raised rectangular shaped lip edges adjacent their upper open ends making it difficult to push debris over the bump like edges into the containers. Additionally, the small flat mouth edges of these references are much too small to allow traditional 24 inch wide brooms and rakes enough space to effectively sweep debris into the containers. Still furthermore, only Burgan '888 allows for a separate dolly to make their container more mobile. However, this separate dolly would add unnecessary space, assembly, and expense requirements in order to be effectively used.

Ridley et al. '369 describes a debris collection apparatus that attaches a scoop to a garbage bag that cannot be moved from a horizontal position to a vertical position since it requires the user to physically lift and separate the scoop from the bag in order place the bag in another cylindrical refuse container. Thus, Riley must be used with other containers to be used.

None of the containers of the prior art allow for the user to easily lift and lower the containers from horizontal to vertical positions and vice versa, solely by using easily reachable handles. The prior art containers generally require the user have to physically lift the container itself about their side walls and/or upper open end edges which makes moving the containers difficult and uncomfortable.

The containers of the prior art are difficult to carry over one's shoulder and back. Completely cylindrical containers tend to wobble and roll and are difficult to hold in place over one's shoulder and back when using one hand. Rectangular shaped containers are uncomfortable when placed over the shoulder and back and cannot be adequately supported by one hand.

The prior art containers when laid on their sides tend to wobble and roll and do not generally remain flush against the ground. Also, when stored, the prior art containers generally cannot be placed flush against walls in storage rooms, garages and the like. Thus, the prior art containers waste space since they cannot be placed flush against walls during storage. None of the refuse containers described above that can lie on their sides can be formed from a single mold, and instead would be expensive and undesirable to manufacture.

The prior art containers generally have a high center of gravity so that when filled the containers are unsteady, tend to wobble and can fall over. None of the containers allow for a both a strong and slopping lip edge to allow debris to be easily slid into the container. Also, none of the containers combine both a wide flat edge large enough to handle 24 inch brooms and rakes while having enough mouth height on the containers to allow one to move substantial amounts of debris into the containers in one sweep.

In addition to the other problems with the prior art, users must physically carry long handled garden tools such as rakes, hoes and shovels when using these containers. Leatherman shows a clip that loosely holds a portion of a garden tool handle. However, long handled tools can easily slip out of the clip, and/or the clip can easily break off. Thus, none of these references allow for attaching, storing and carrying tools such as rakes and brooms with debris containers.

Additional problems with most trash receptacles are that they are impractical when used on their sides to sweep refuse into the containers. For example, tubular containers and rectangular containers usually require reinforced thick edges that do not allow for the containers when being laid on their sides to be able sweep refuse in.

Over the years some attempts have been made to adapt dust pans with refuse containers. U.S. Pat. No. 4,312,531 to Cross and U.S. Pat. No. 4,802,258 to Jensen have large dust pans that can attach to edges of the open end of trash can. However, Jensen '258 is a full size dustpan with handle that can slide over the edge of trash can outer edge. As such, this dust pan needs to have space to be stored, and appears to be restricted for attachment to rounded edges of a circular trash can. Cross '531 requires a bendable insert and large funnel to be used with a trash can, which is also undesirable for storage, and also appears to be unusable for trash cans having flat side edges.

U.S. Des. 351,699 to Temple shows a circular trash container with a funnel built into an outer edge of a lid cover, which also would not be usable with a trash receptacle having flat side edges.

U.S. Pat. No. 4,659,045 to Flynn describes a "trash bagging kit", title, that is only useful as an insert for opening an end of a trash bag, and has a slidable ramp edge that appears to loosely fit and would not be secure to the flat edge. In other words the slidable ramp would easily disengage and fall off during use, and would not be practical.

U.S. Des. 351,705 to Bird et al. describes a "combined dust pan and trash container lid ", that requires an elaborate lid that when taken off the trash receptacle can be used as a separate dust pan. However, this lid would not be able to be used to push and slide refuse into a container that is put on its side.

Thus, the need exists for solutions to the above problems.

SUMMARY OF THE INVENTION

A primary objective of the invention is to provide a novel refuse container with a triangular-torpedo shaped flat side wall that allows the container to remain flush to a planar ground surface, and easily raised upright when needed.

A secondary objective of the invention is to provide a novel refuse container with flat side wall having three handles substantially perpendicular to one another so that the container can be easily moved from a standing position to a side position and vice versa solely using the handles.

A third objective of the invention is to provide a novel refuse container having different mouth shaped opening than the bottom closed portion while allowing for a low center of gravity for keeping the container in a stable upright position when filled.

A fourth objective of the invention is to provide a novel refuse container with flat side wall having a generally triangular-tubular outer shaped edge with gradually curving interior contour walls that allow for easy filling of the container while it is laid on its side.

A fifth objective of the invention is to provide a novel refuse container with a flat side edge that is large enough to receive a 24 inch rake or brush broom head so that all debris from the 24 inch rake or brush head can be swept into the container.

A sixth objective of the invention is to provide a novel refuse container having a flat upwardly sloping ramp inlet portion for allowing easy access to sweep debris into the container while having a blunt tip edge strong enough to withstand heavy use without tearing or breaking apart.

A seventh objective of the invention is to provide a novel refuse container with flat side wall for laying the container on its side and having reinforced side walls for durability so that the container remains sturdy when vertically raised.

An eighth objective of the invention is to provide a novel refuse container with flat side wall having a completely removable lid cover that can easily snap over the open end of the container.

An ninth objective of the invention is to provide a novel refuse container with flat side wall having a completely removable lid cover that can easily attach onto and hinge over the open end of the container.

A tenth objective of the invention is to provide a novel refuse container with flat side wall with wheels mounted for easy mobility.

An eleventh objective of the invention is to provide a novel refuse container that can have molded holders for securely holding, storing and carrying handle tools such as rakes, hoes, brooms, and the like, to the outer side of the container.

A twelfth objective of this invention is to provide a novel refuse container that can have through-holes in a lid of the container to allow the handles on tools such as rakes, hoes, shovels, and brooms, to be inserted, supported and carried by the container.

A thirteenth objective of the invention is to provide a novel refuse container that when filled can be comfortably supported by a single handle over one's shoulder and back when moved and remains both steady and stable when held by one hand over one's shoulder and back.

A fourteenth objective of the invention is to provide a novel refuse container that can easily lay flush against a wall surface when not being used and not taking up unnecessary space for storage.

A fifteenth objective of the invention is to provide a novel refuse container that can directly lay flush against the ground and does not tend to wobble or roll when empty, or when being filled with debris.

A sixteenth objective of this invention is to provide a novel reinforced dust pan that can be easily attached to a refuse container so as to allow for most refuse containers to be able to be laid on one side so that refuse can be directly swept into the container.

A seventeenth objective of this invention is to provide a novel reinforced dust pan that is small compared to existing dust pans, and can be easily stored when not used.

An eighteenth objective of this invention is to provide a novel reinforced dust pan that can be easily snapped on and off mouth edges of most refuse receptacles.

A nineteenth objective of this invention is to provide novel bag tabs along the lower and outer portion of the containers double wall rim/lip at the container opening so the user can secure and utilize lawn bags so as to prevent the bag from collapsing and falling into the container while debris is swept or placed in the container A preferred embodiment of the refuse container can include a generally semi-tubular container formed from molded plastic having a closed bottom end having a substantially circular configuration and an open end having a substantially D-shaped configuration, the container can have rounded side walls with a non-rectangular shaped flat side wall portion on the container. The flat side wall can have a configuration that is triangular shaped, torpedo shaped, or a combination of triangular torpedo shaped. The containers can include at least one handle at an apex portion of the D-shaped open end located substantially midway from the non-rectangular shaped flat side wall portion for allowing the container to be physically moved from a standing upright position to a side oriented position with the container laying on the non-rectangular flat side wall so that the container can be filled with debris, and the handle can also allow the container to be easily moved back to the standing position.

Along a flat edge of the D-shaped opening can be an angled ramp for allowing debris to be easily swept into the container. The angled ramp can have a straight upwardly sloping planar ramp portion, and include a rounded blunt tip leading to the straight upwardly sloping planar ramp portion. The flat edge of the ramp can be approximately 24 inches long so that an approximately 24 inch wide broom head or approximately 24 inch wide rake head can easily slide and move all the debris being swept in each sweeping stroke into the mouth end of the container.

Inside of the container, the inner walls can have only non-sharp angled interior surfaces such as concave curved surfaces so that debris easily slides inside of the container towards the closed bottom end.

Embodiments of the invention can include three handles arranged around upper curved side portions of the container. For example, the containers can include a left handle on the upper curved side adjacent to a left side of the flat side wall portion, a right handle on the upper curved side substantially adjacent to a right side of the flat side wall portion, and a middle handle on the upper curved side substantially between the left side of the flat side wall portion and the right side of the flat side wall portion.

Molded plastic lids can be used with the containers such as a lid being hingedly attached onto the open end of the container to close off the open end of the container.

A wheeled embodiment can include at least one wheel snapably mountable and removable to the bottom of the container for allowing the container to be easily mobile.

Holder(s) can be molded onto an outer side wall of the container for allowing a handle of an implement to slide into the holder and be held in place parallel to and alongside of the container. The container can then carry implements such as but not limited to rakes, brooms, hoes, and shovels.

The tool implements can also be supported by opening(s) in a lid of the container so that handles to the tools can be inserted into the opening(s) and then carried by the container.

Novel methods for using the receptacle containers can include positioning the cylindrical container having a closed end and an open end into a horizontal side oriented position on a non-rectangular flat side exterior wall portion of the container, the open end having a substantially D-shaped opening with a flat side edge, and the closed end being substantially circular shaped. The next step can include sweeping debris by an approximately 24 inch wide tool head such as a 24 inch wide rake head or 24 inch broom head onto the flat side edge of the D-shaped opening wherein a single sweep moves all debris along the approximately 24 inch wide tool head into the open end of the container. The final step when sweeping has been completed can include lifting the container from the side-oriented position by a single handle positioned along an apex portion of the D-shaped opening to a vertically standing position, wherein the debris slides along interior curved contour walls of the container to move substantially toward the closed bottom end of the containers.

A preferred embodiment of a detachable reinforced dust pan for refuse receptacles can include a generally rectangular upper flap having a generally convex surface between a connecting edge and an exposed edge, a generally rectangular lower flap having a generally convex surface between a connecting edge and an exposed edge, and a ramp tip that is formed between the connecting edge of the upper flap and the connecting edge of the lower flap, wherein the rectangular upper flap and the rectangular lower flap are adapted to clip about an exposed edge of refuse container. The rectangular upper flap, the rectangular lower flap, with the ramp tip can be formed from plastic, fiberglass, composites, and the like. Metal such as aluminum or galvanized metal can also be used.

The generally rectangular upper flap can have a curved convex outer surface, and the generally rectangular lower flap can have a generally flat portion extending outward from the connecting edge, to an inclining flat portion, which passes to a bent exposed edge. The detachable reinforced dust pan is able to snap about flat edges of refuse containers allowing the refuse containers to be able to be laid on their side so that refuse is able to be swept into the refuse containers.

The ramp tip can be a blunt narrow tip having a slightly rounded tip edge and slightly triangular in shape with a greater thickness than a thickness of both the upper flap and the lower flap.

The dust pan can have a generally rectangular configuration having a length substantially larger than a width when viewed from above or below. The generally rectangular configuration of the dust pan can have a length of approximately 6 to approximately 24 inches from side to side, and a width of approximately ½ inch to approximately 6 inches between the ramp tip and the exposed edges of the upper and the lower flaps. The thickness of the upper and lower flaps can be up to approximately 1/10 inches or greater in diameter. The upper flap and the lower flap can have a generally C cross-sectional shape.

The convertible refuse receptacle can include a combination of manufacturing and/or selling and/or distributing a combination of a refuse container having an open end and a closed end, the open end having at least one flat side outer edge, along with a snapable dust pan having a generally rectangular configuration with a length substantially larger than a width, an open end forming a clip, and a closed end forming a ramp edge, the clip open end for snapping about the one flat side outer edge of the refuse container.

The refuse container can have a semi-tubular and/or D shaped configuration, with at least one flat side wall. Alternatively, the refuse container can be a rectangular shaped container. Alternatively, the container can be pliable walled cylindrical container.

A method of converting a refuse receptacle into a dust pan with the refuse receptacle can include the steps of providing a refuse container having an open end with at least one flat outer side edge, and a closed end, providing a dust pan a having a generally rectangular configuration with a length substantially larger than a width, an open end forming a clip, and a closed end forming a ramp edge, clipping the clip open end for about the one flat side outer edge of the refuse container so that the ramp edge is slightly raised above the one flat outer side edge, and the dust pan is snapped into place, laying the refuse container on one side so that the ramp edge abuts against a ground surface and sweeping refuse into the refuse container by the ramp edge of the dust pan.

The dust pan can be attached to a flat side rim portion that can be formed on the open end of a cylindrical refuse container having pliable walls and rims. A method of using the dust pan with a cylindrical container can allow for a user to lay the cylindrical container on one side, and the user press the upper rim edge of the open end so that an opposite portion of the rim edge abutting the ground would flatten out. Next, a dust pan adapter that can be sized up to approximately 6 inches in length can be snapped over the ground flattened rim portion, which would create a ramp that allows debris to be easily swept into the container while it is laid on one side. The dust pan adapter can be strong enough to potentially maintain the flattened rim portion while it is snapped in place.

Further objects and advantages of this invention will be apparent from the following detailed description of the presently preferred embodiments which is illustrated schematically in the accompanying drawings.

BRIEF DESCRIPTION OF THE FIGURES

FIG. 19A is a top perspective view of a hinge lid for use with the container embodiments.

FIG. 19B is a bottom perspective view of the hinge lid of FIG. 19A.

FIG. 22A is a top perspective view of a novel snap lid with openings for supporting the handles of implements such as brooms, rakes and shovels.

FIG. 22B is a bottom perspective view of the lid with openings of FIG. 22A.

FIG. 25 is a perspective view of a preferred reinforced dust pan adapter.

FIG. 26 is a side cross-sectional view of the dust pan adapter of FIG. 25.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention is a Continuation-In-Part of U.S. patent application Ser. No. 11/522,212 filed Sep. 15, 2006, now issued as U.S. Pat. No. 7,469,798, which is a divisional application of U.S. patent application Ser. No. 10/646,480 filed Aug. 23, 2003, now issued as U.S. Pat. No. 7,185,783, which claims the benefit of priority to U.S. Provisional Application No. 60/405,452 filed Aug. 23, 2002, all of which are incorporated by reference.

Figure 1:
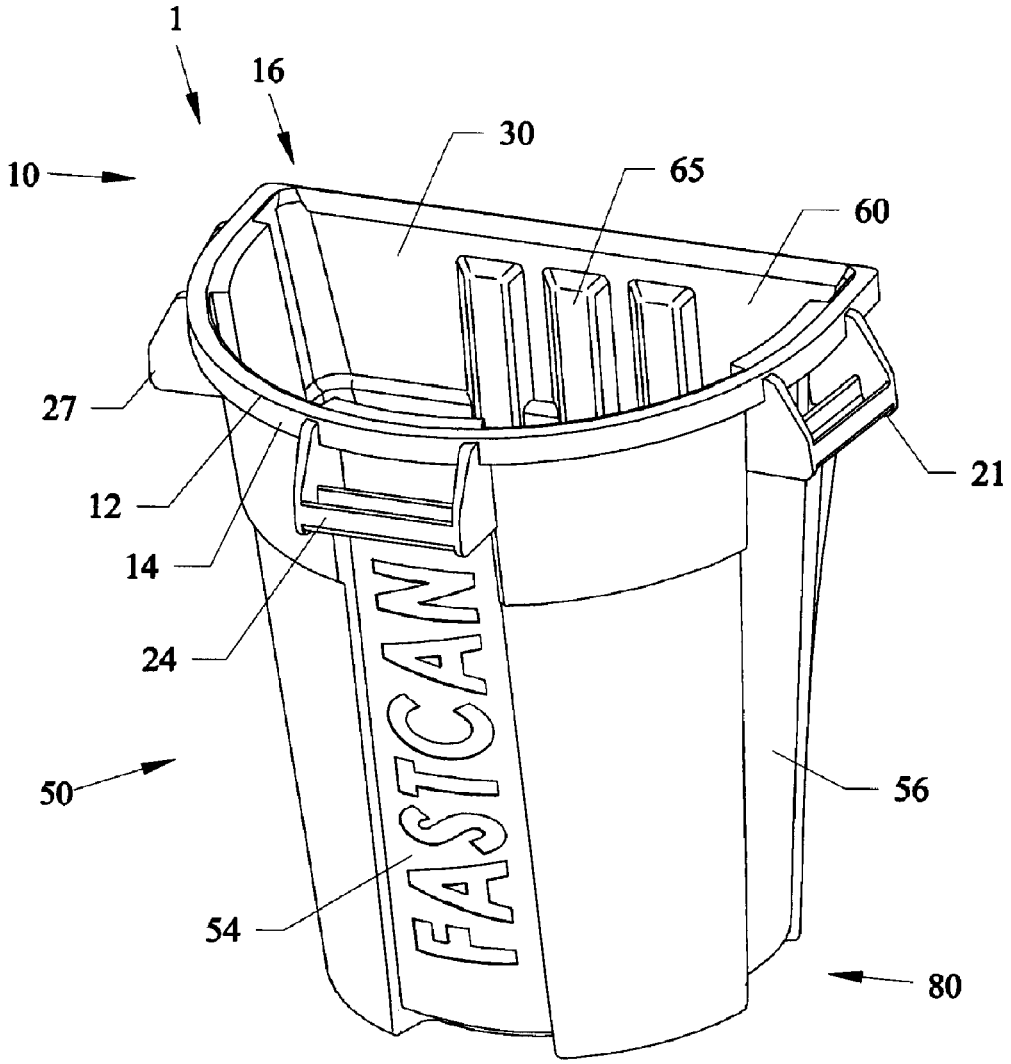
FIG. 1 is a front upper right perspective view of a first embodiment of the novel outdoor refuse container.
Figure 2:
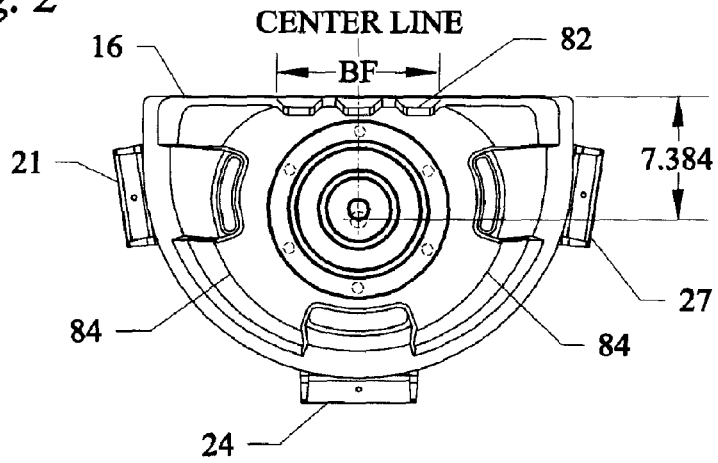
FIG. 2 is a bottom view of the embodiment of FIG. 1.
Figure 3:
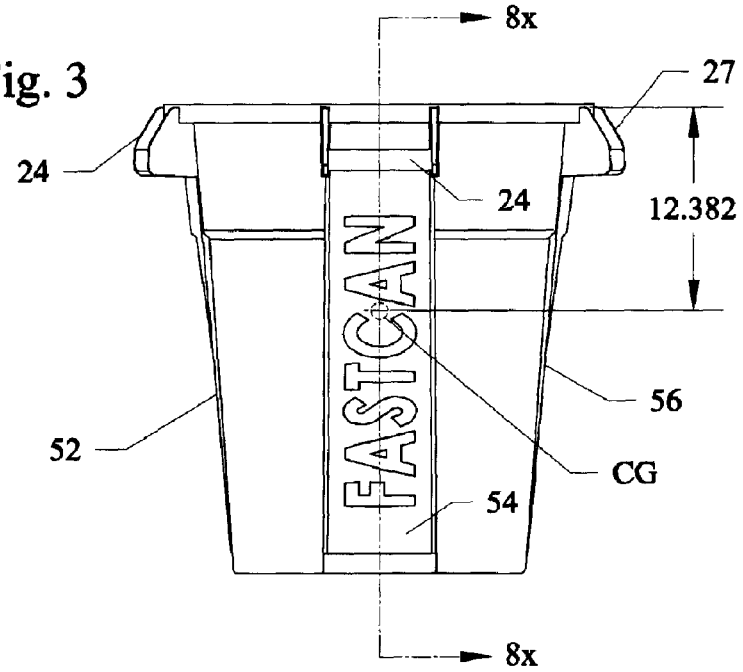
FIG. 3 is a front view of the embodiment of FIGS. 1-2.
Figure 4:
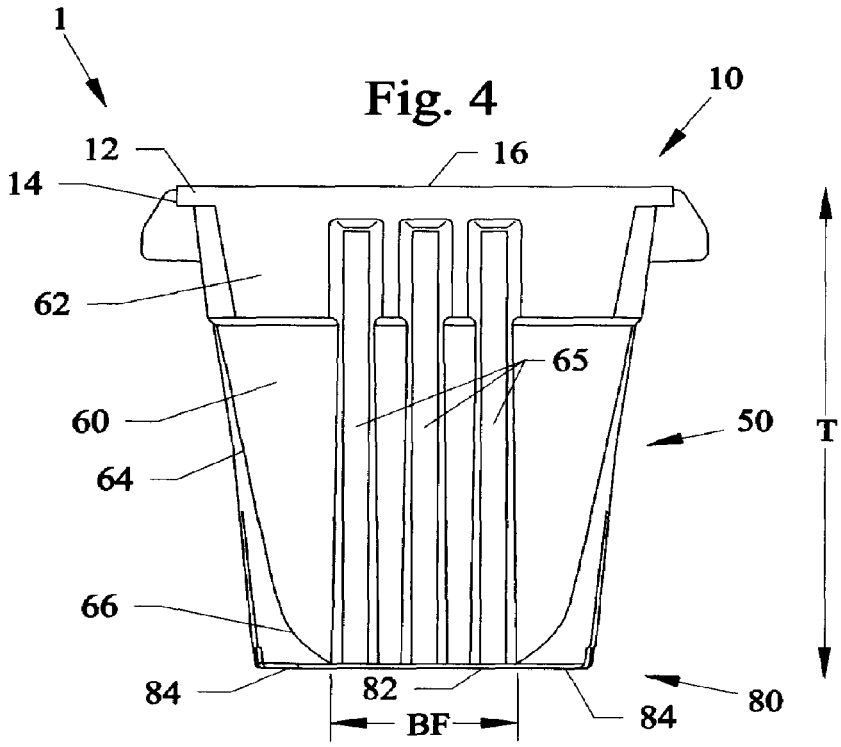
FIG. 4 is a rear view of the embodiment of FIGS. 1-3.
Figure 5:
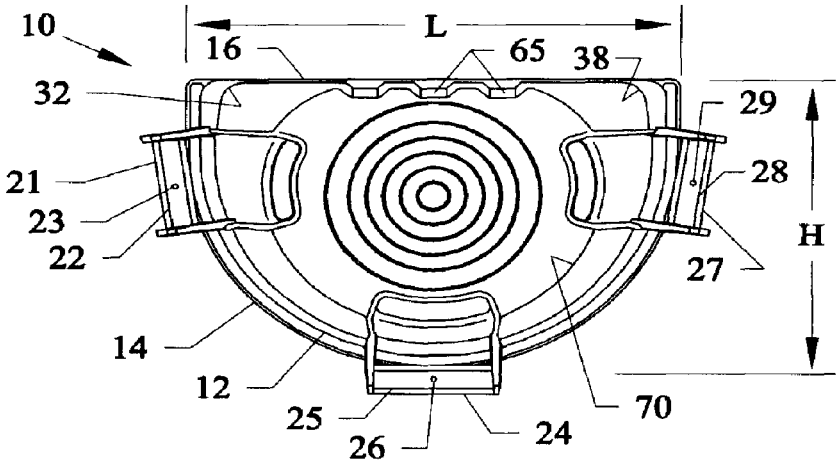
FIG. 5 is a top view of the embodiment of FIGS. 1-4.
Figure 6:
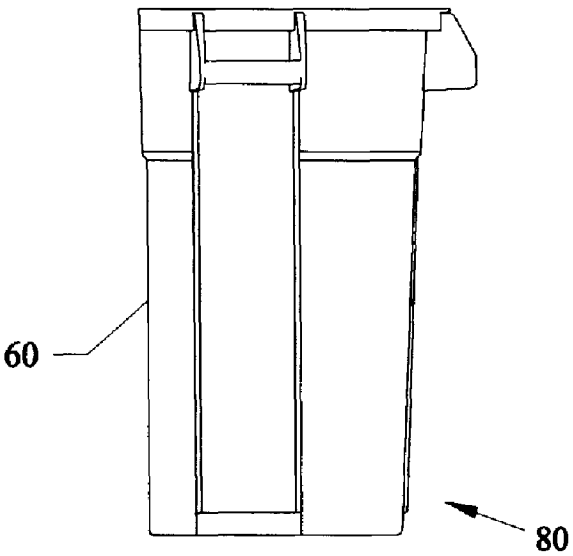
FIG. 6 is a side view of the embodiment of FIGS. 1-5.
Figure 7:
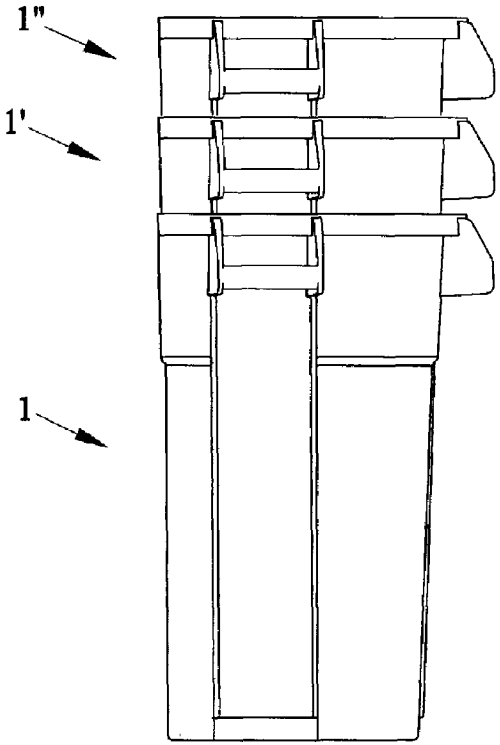
FIG. 7 is a side view of stacked containers of the first embodiment of the preceding figures.
Figure 8:
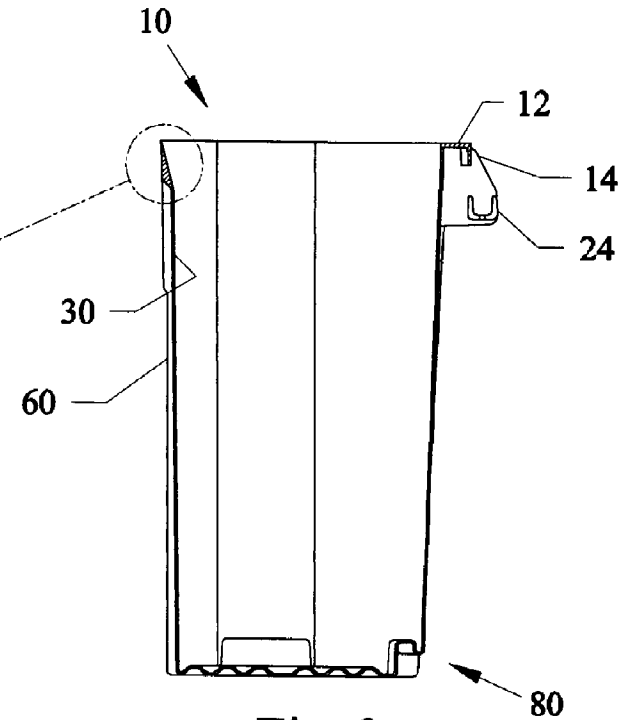
FIG. 8 is a cross-sectional view of the embodiment container of FIG. 3 along arrows 8X.
Figure 8A:
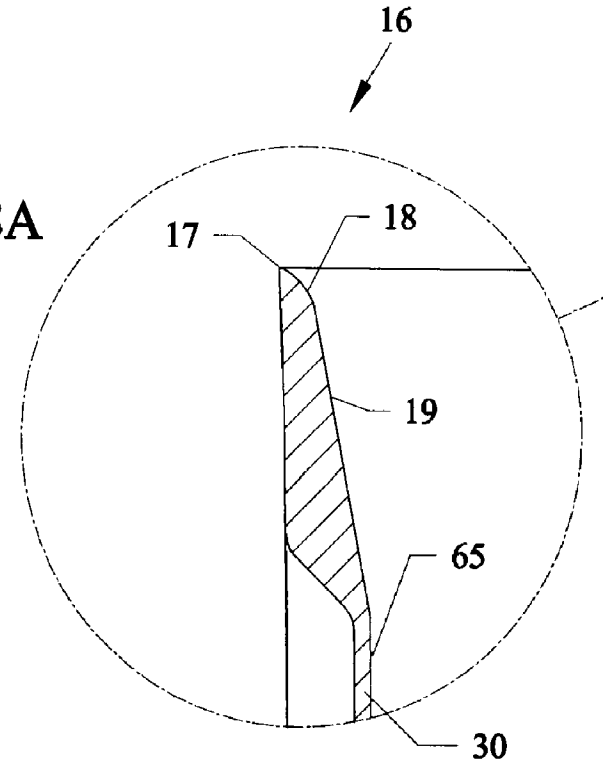
FIG. 8A is an enlarged view of the sloping scoop edge portion of the container of FIG. 8.

FIG. 1 is a front upper right perspective view of a first embodiment of the novel outdoor refuse container 1. FIG. 2 is a bottom view of the container 1 of FIG. 1 showing the substantially circular configuration bottom end 80. FIG. 3 is a front view of the container 1 of FIGS. 1-2. FIG. 4 is a rear view of the container 1 of FIGS. 1-3 showing the triangular-tubular shaped flat side wall portion 60. FIG. 5 is a top view of the container 1 of FIGS. 1-4. FIG. 6 is a side view of the container 1 of FIGS. 1-5. FIG. 7 is a side view of stacked containers 1, 1', 1". FIG. 8 is a cross-sectional view of the container 1 of FIG. 3 along arrows 8X. FIG. 8A is an enlarged view of the sloping scoop edge portion 16 with rounded blunt end and slopping ramp portion.

Referring to FIGS. 1-8A, a first embodiment container 1 can be formed in a single piece from injection molded plastic, and the like, and have an open upper end portion 10 that can include a substantially D-shaped cross-sectional configuration defining an exterior surface and interior wall surface with the D-shaped configuration being slightly larger than a half-circle of upper inside diameter of approximately 13 inches and outer diameter of approximately 14.5 inches. Container 1 includes a longitudinal middle portion 50 having a configuration that changes from the substantially D-shaped cross-sectional shaped upper end 10 to a substantially circular (approximately 75% to approximately 85% circular end portion 80 defining an exterior surface and interior wall surface. The bottom end 80 can include a substantially flat edge 82 having a length BF of approximately 10 inches, and curved sides forming a substantial circle shape having a diameter of approximately 17.5 inches.

The container 1 can have a tall length T of approximately 28 inches tall. The middle portion 50 can include a flat side 60 having a generally triangular and tubular shaped configuration starting with a wide base portion 62 adjacent flat edge 16 curved sides 64 to curved tip side portion 66 which ends at flat edge portion 82 on the bottom circular end portion 80 of the container. Thus, flat side 60 can be triangular-tubular shaped with a blunt tip end.

Referring to FIGS. 1, 2 and 5, and 8A, the flat edge 16 of container 1 can include curved outer edges 32 and 38 to both sides of the flat interior floor 30 so that refuse easily slides into container 1. The inside of the container 1 has curved substantially concave shaped surfaces which run to the bottom curved walls 70 of the container adjacent to the bottom end 80 of the container so that debris can be easily swept into the container and allowed to slide to bottom end 80. Preferably there are no sharp interior edges and corners that can trap debris therein. As previously described flat edge 16 on mouth end 10 of the container can be up to approximately 24 inches wide inside of the container 1 so as to easily allow an approximately 24 inch wide rake or broom head to be able to completely sweep an entire 24 inch long amount of debris into the container 1 while it is laying on its flat side 60.

Referring to FIGS. 1, 5, 8 and 8A, upper end 10 can include a flat lip edge 12 of approximately ½ inch to approximately ¾ inch wide and an overhang portion 14 of approximately 1 inch high, that run in a substantially slightly greater than half circle configuration about the upper end 10 of the container 1. Edge 12 and overhang 14 aid in reinforcement of the open mouth end 10 to the container 1. Mouth end 10 can have a flat side 16 having an inside open length L of approximately 23⅝ inches, and a height opening H of approximately 17⅜ inches.

Flat side 16 can have a blunt tip end 17 that can be approximately 1/20 of an inch thick, which leads to a rounded surface portion 18, which then leads to a sloping ramp portion 19 that gradually slopes upward into a thickness of up to approximately ¼ inch thick and then into the flat sidewall 30 inside of container 1. The shape and thickness of flat side 16 can aid in the stability of the container when both laid on its side for allowing debris to be swept therein, and also when the container is stood upright so that the container does not lose its shape and remains sturdy when full. Flat sidewall 30 can be thinner than the thickness of the upper end of ramp portion 19.

Referring to FIGS. 1-8A, three handles 21, 24 and 27, can be molded onto the container 1 about the D-shaped mouth end 10 and extend up to approximately 3½ inches below the mouth end 10 of the container. A left handle 21 can be located to the left of flat edge 16, with a right handle 27 to the right of the flat edge 16, and a middle handle 24 mounted on the top of the D-shaped curved portion 12, 14 of mouth end 10. Right handle 27 and left handle 21 can be located approximately 4 to approximately 6 inches from flat edge 16. Each of the handles 21, 24, 27 can include half cylindrical cup portions 22, 25, 28 with lower facing curved surfaces that allow users to easily wrap their hands under the handles 21, 24, 27, and small through-holes 23, 26 and 29 therethrough for allowing water to drain through and not collect in the cup portions 22, 25, 28 when the container is in an upright standing position. The handles 21, 24 and 27 allow the user to easily lift the container from horizontal to vertical positions and vice versa, as well as allow a single user to carry the container 1 without having to grip any sidewalls of the container itself.

Referring to FIGS. 1-8A, along the middle portion 50 of the container can be parallel rounded bottom indentations 65 running along the flat side 60 of the container that are substantially perpendicular to the mouth end 10 and bottom end 80. Although three indentations 65 are shown, more or less can be used as needed to aid in reinforcing and strengthening the container 1 so that the container 1 keeps its shape when standing or laying on its side and when either empty, being filled and completely filled. Unlike the prior art, the novel refuse container 1 can be placed flush against the ground and does not tend to wobble or roll when either empty or when being filled.

Along the curved wall surface of middle portion 50 can also be parallel flat bottomed indentation portions 52, 54, 56 each being substantially perpendicular to the mouth end 10 and bottom end 80 that are also used for reinforcing and strengthening the container 1 so that the container maintains its shape when laid on its side, standing upright, and whether the container 1 is empty, being filled or completely filled. An engraved or molded on indicia label such as "FASTCAN" can be located inside one of more of the indentations 52, 54, and 56. The three reinforcement indentations 52, 54, and 56 can be located directly beneath the handles 21, 24 and 27 so that the user can have more room to position their hand closer to the sides of the container 1 when gripping the handles 21, 24 and 27.

Referring to FIGS. 2-3, a container 1 completely filled with debris can have a center of gravity CG approximately 12.382 inches from the mouth end 10 of the container and approximately 7.384 inches from the flat edge 16 inside of the container 1. The center of gravity CG is low enough that the container remains very stable when standing upright and cannot be easily tipped over. The low center of gravity CG allows for better stability when the container is being filled, and also allows for easy stacking and nesting of plural containers with one another. The stacking of the containers 1 as shown in FIG. 7, where three containers 1, 1' and 1" are shown to be easily stackable within one another. The novel containers 1, 1', 1" can be easily placed against a wall inside a storage room, garage, and the like and remain flush against the wall without taking up any unnecessary space.

Figure 10:
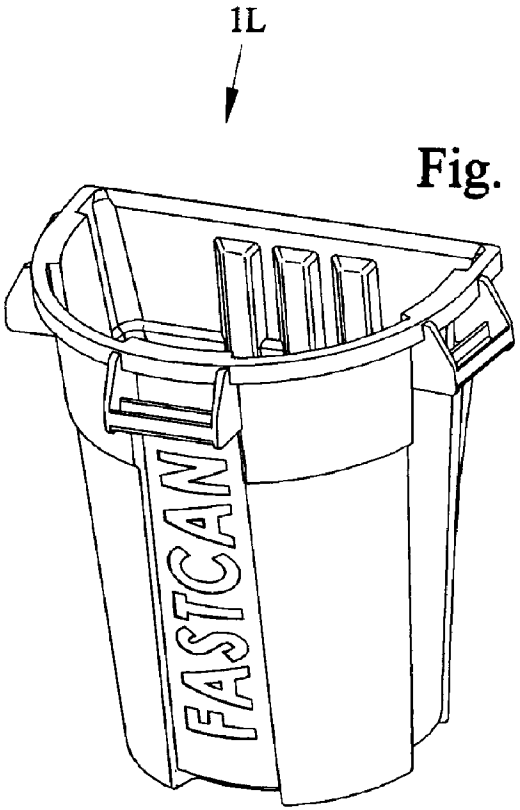
FIG. 10 is a perspective view of a 45 gallon container embodiment of the invention.
Figure 9:
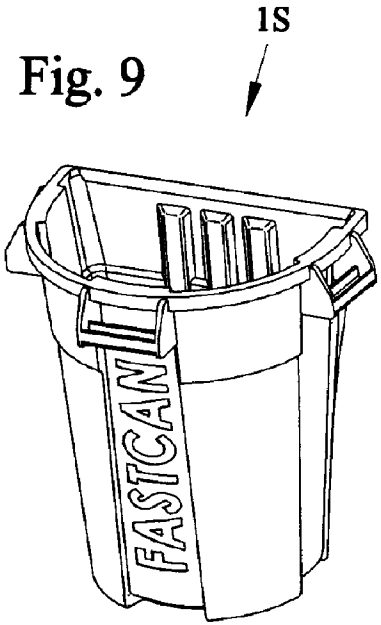
FIG. 9 is a perspective view of a 30 gallon container embodiment of the invention.

FIG. 9 is a perspective view of a container embodiment 1S of the invention that can be sized to hold approximately 32 gallons of debris therein. FIG. 10 is a perspective view of another container embodiment 1L of the invention that can be sized to hold approximately 45 gallons of debris therein. Both embodiments 1S and 1L can have similar novel shaped configurations as that described in the previous figures. As shown by FIGS. 9 and 10, the novel invention can be sized to include approximately 30 gallon trash bags as well as approximately 45 gallon trash bags. The invention can use a 45 gallon/XXL lawn bag for a 32 gallon sized novel container. Since the opening of a 45 gallon can be the same as the 32 gallon can, trash bags for approximately 40 to approximately 50 gallons can be used.

Figure 11:
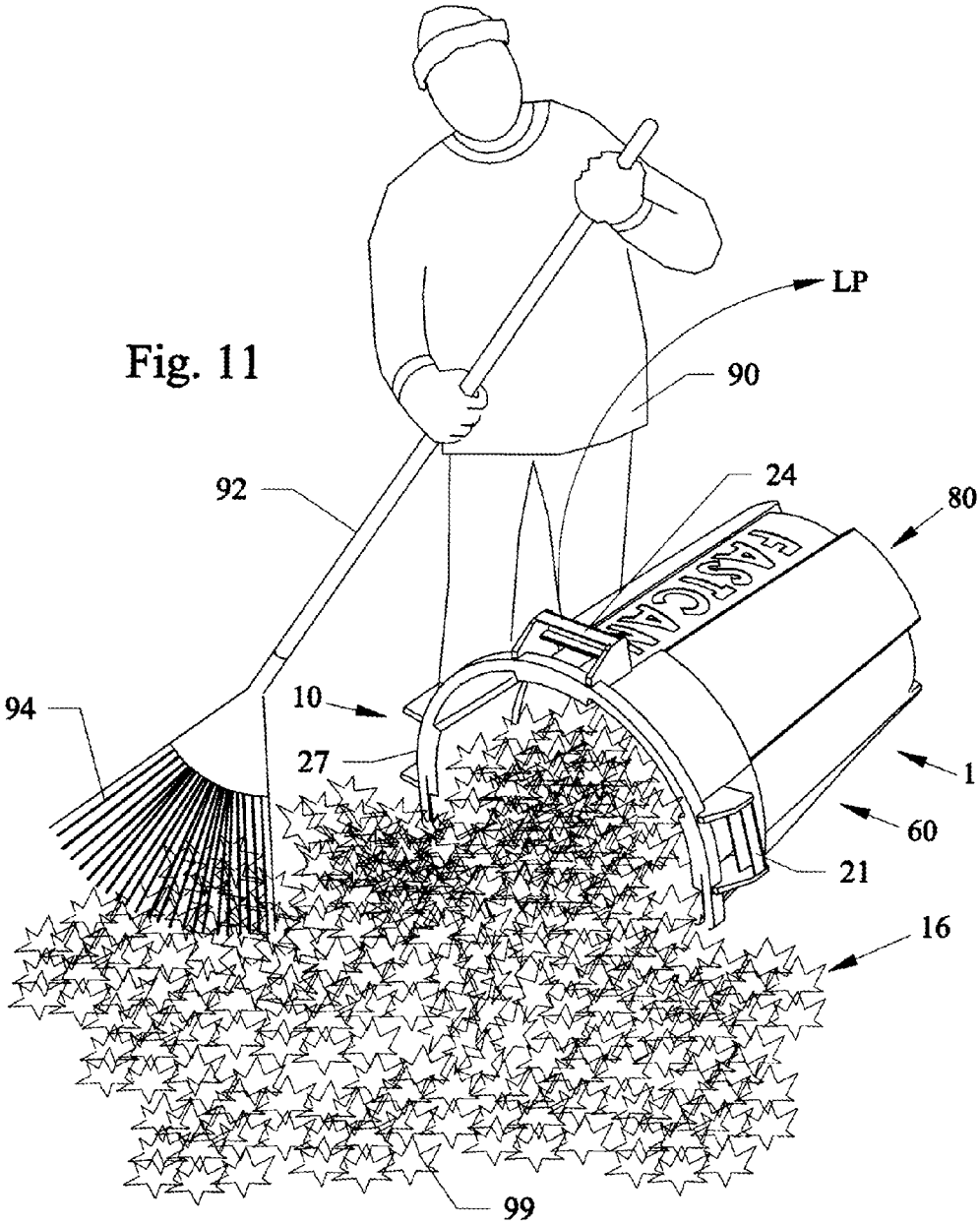
FIG. 11 shows an application of the container invention for use with landscaping

FIG. 11 shows an application of the container invention 1 of the preceding figures for use with a landscaping application. Here, a user can easily move the container 1 from a vertical upright position as previously shown by FIGS. 1, 3, 4, 6, 9 and 10 to a side orientation where the container 1 is laying on its flat side wall portion 60 by handles 21, 24, and 27. The user 90 can hold the long handle 92 of an implement such as a rake to move debris 99 into the container by the implement head 94. Here, an approximately 24 inch wide rake head 94 can easily move an entire 24 inch width amount of debris over the approximately 24 inch flat side edge 16 of the container into the container 1. When finished the user 90 can easily lift the container 1 by only having to pull up on top handle 24 in the direction of arrow LP without having to physically handle the sides or mouth edges of the container, and thus does not have to directly contact any of the debris that is inside the container 1.

When the novel refuse container is filled, the apex located handle 24 can be used to raise the container 1 so that the rounded side 50 can be comfortably supported over one's shoulder and back when moved. The novel shape configuration of the container that includes the flat wall portion 60 distributes the debris and weight inside the container with the center of gravity so that the filled container 1 remains both steady and stable when held by one hand over one's shoulder and back, and still remains comfortable by the curved side resting against the shoulders and back of the user.

Figure 12:
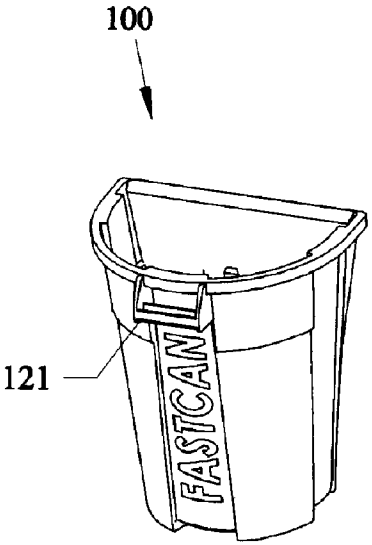
FIG. 12 is a perspective view of a 7 gallon container embodiment of the invention.

FIG. 12 is a perspective view of another embodiment 100 of the invention wherein an approximately 7 gallon container can include the novel features of the invention previously described. Here, the container 100 can be used indoors and only need one handle 122 along the apex portion of D-shaped mouth portion of the container 100 for allowing the container to be laid on its side, raised and lifted as needed.

Figure 13:
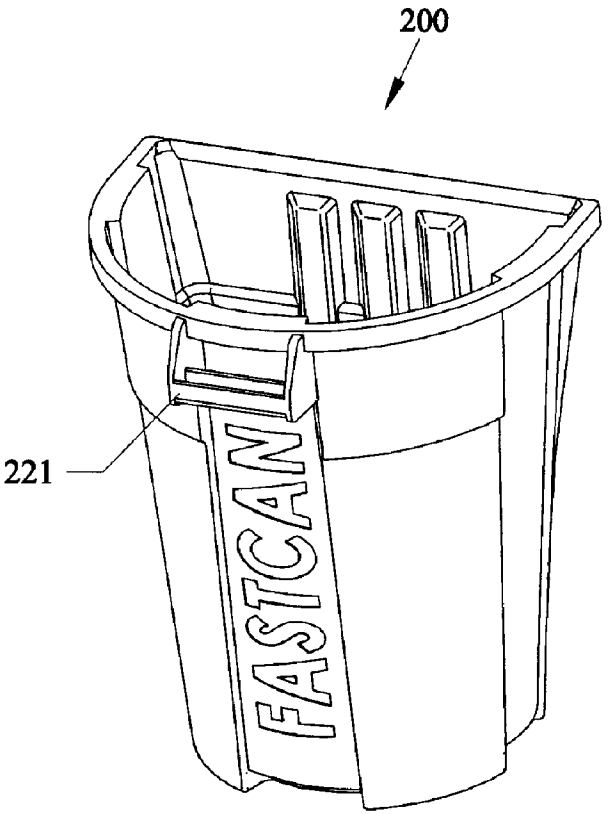
FIG. 13 is a perspective view of a 13 gallon container embodiment of the invention.

FIG. 13 is a perspective view of another embodiment 200 of the invention where an approximately 13 gallon container can include the novel features of the invention previously described. Here, the container can also be used indoors and only need one handle 222 along the apex portion of the D-shaped mouth portion of the container 200 for allowing the container to be laid on its side, raised, and lifted as needed.

Figure 15:
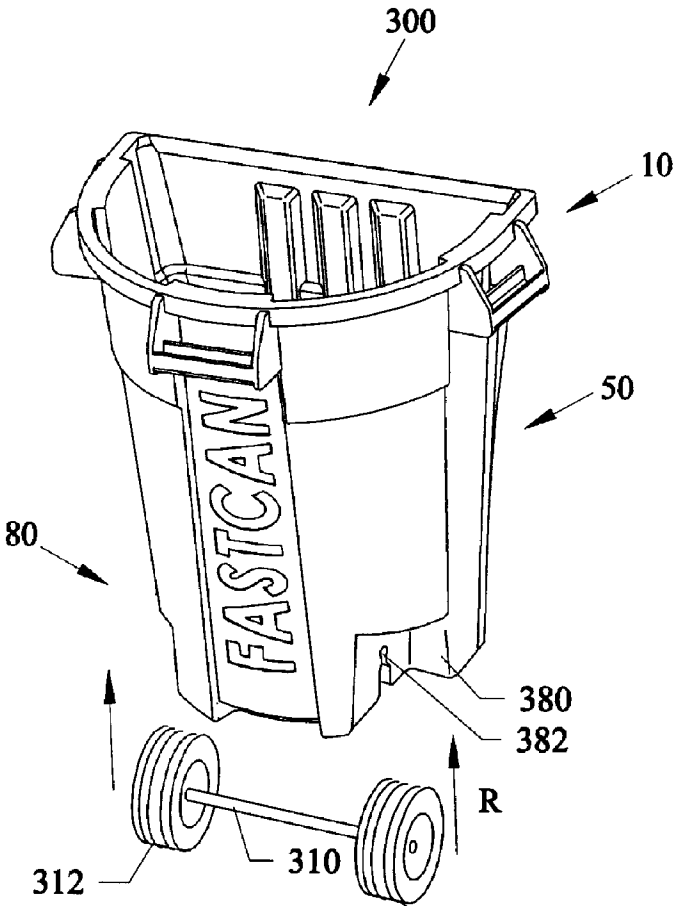
FIG. 15 is an exploded view of the wheels detached from the container of FIG. 14.
Figure 14:
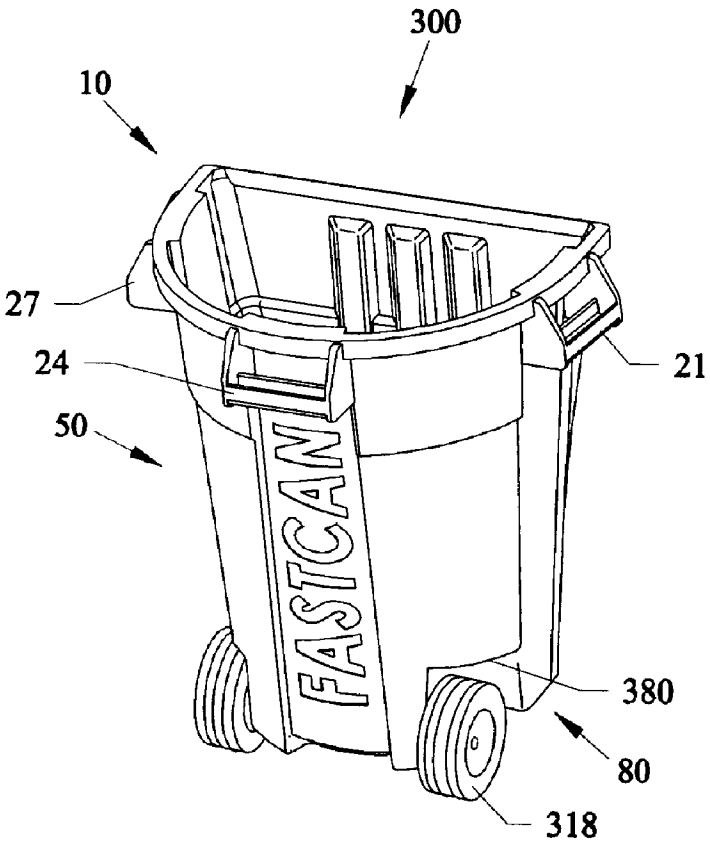
FIG. 14 is a perspective view of a wheeled container embodiment of the invention.
Figures 16, 17, 17A:
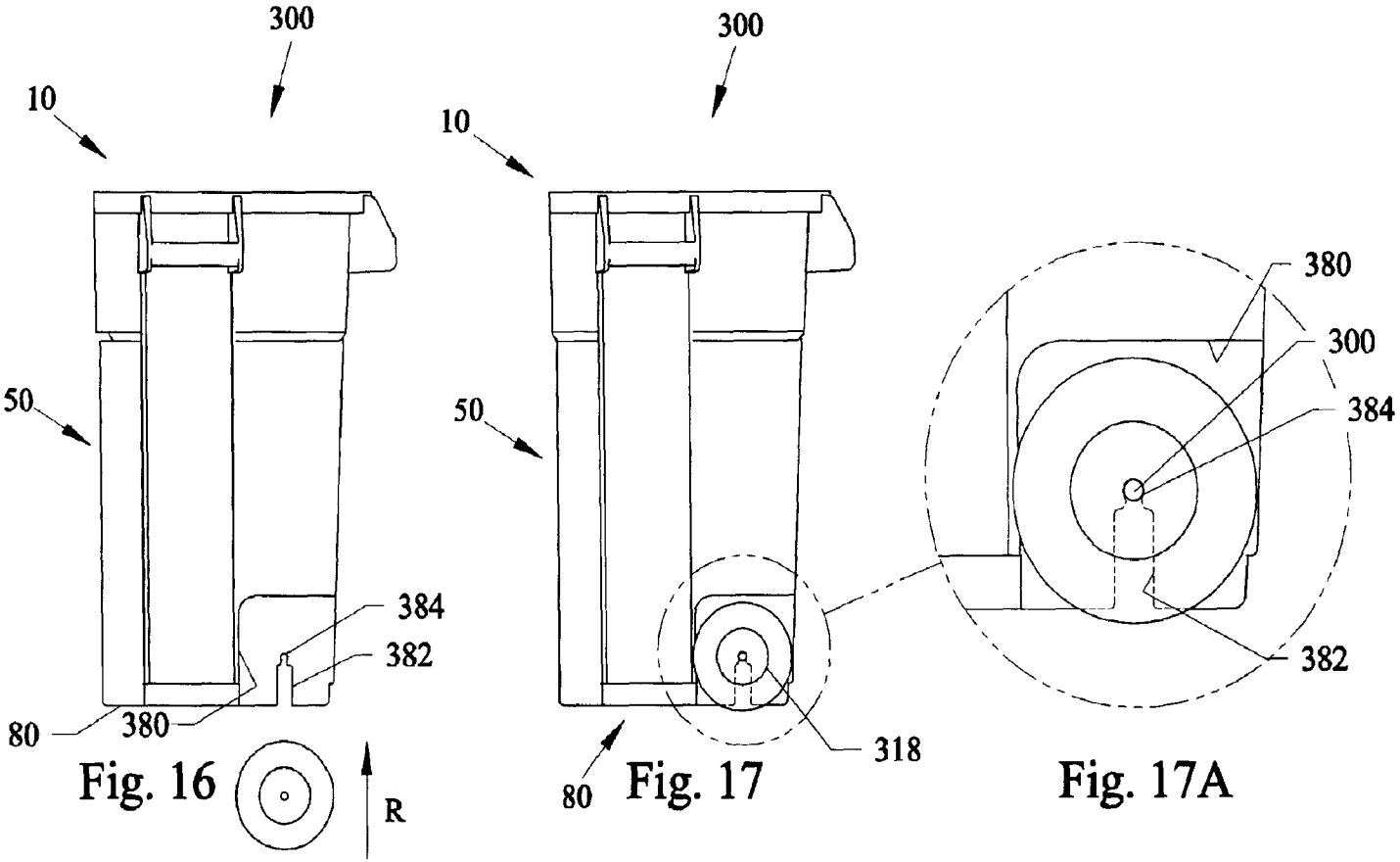
FIG. 16 is a side view of the container and wheels of FIG. 15.
FIG. 17 is a side view of the wheeled embodiment of FIG. 14.
FIG. 17A is an enlarged view of the wheels attached to the container of FIG. 17.
Figure 18:
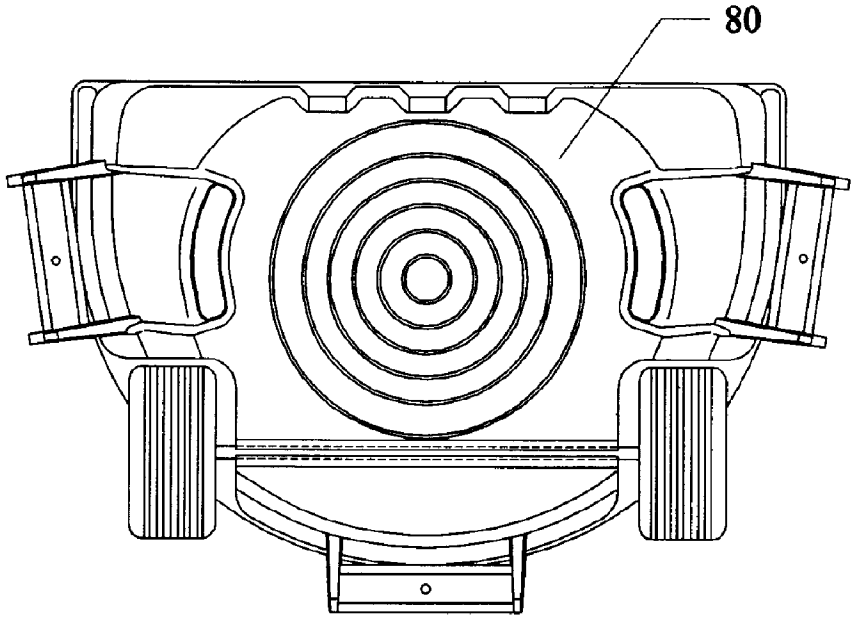
FIG. 18 is a bottom view of the wheeled container of FIGS. 14-17A.

FIG. 14 is a perspective view of a wheeled container embodiment 300 of the invention which can have similar features 10, 50 and 80 to the previous embodiments described above. FIG. 15 is an exploded view of the wheels 312, 318 detached from the container 300 of FIG. 14. FIG. 16 is a side view of the container 300 and wheels 312, 318 of FIG. 15. FIG. 17 is a side view of the wheeled embodiment 300 of FIG. 14. FIG. 17A is an enlarged view of the wheels 312, 318 attached to the container 300 of FIG. 17. FIG. 18 is a bottom view of the wheeled container 300 of FIGS. 14-17A. Referring to FIGS. 14-17A, an axle 310 having wheels 312, 318 connected to the axle 310 can be attached to the bottom end 80 of the container 300 by being moved upward in the direction of arrow R so that the axle 310 slides into a groove 382 and keyhole notch 384 which can snapably hold the axle 310 in place. Indented portions 380 in the bottom 80 of the container 1 can function as wheel wells so that the wheels 312, 318 can be positioned close to under the container 300. The container 300 can be tilted backward by at least handle 24 so that the container can ride over a ground surface by wheels 312, 318 allowing a container 300 that is filled with debris to be easily mobile when needed. The wheels 312, 318 can also be removed from the container 300 by pulling the wheels downward in an opposite direction to that of arrow R allowing the axle 310 to snap out of the notch 384 so that the container can also be used without any wheels.

Figure 20:
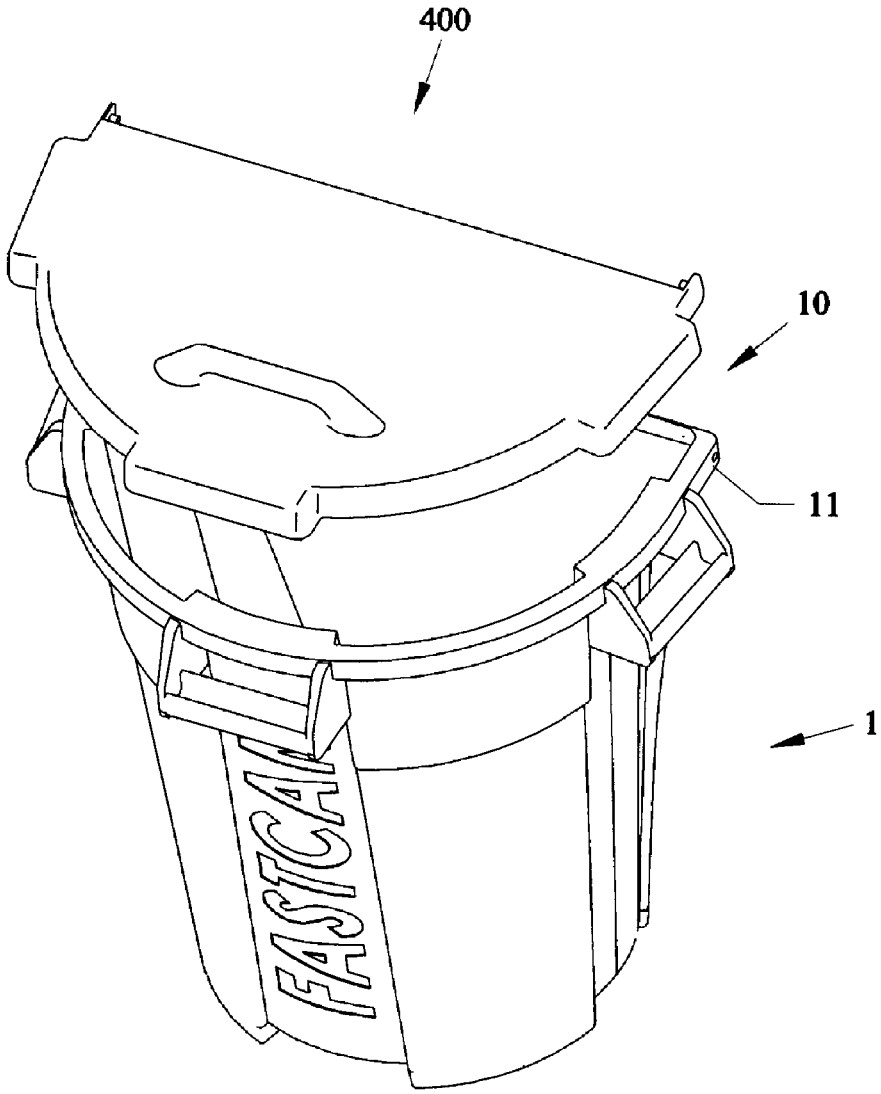
FIG. 20 is a perspective view of the novel lid of FIGS. 19A-19B being attached to the novel container of the preceding embodiments.
Figure 21B:
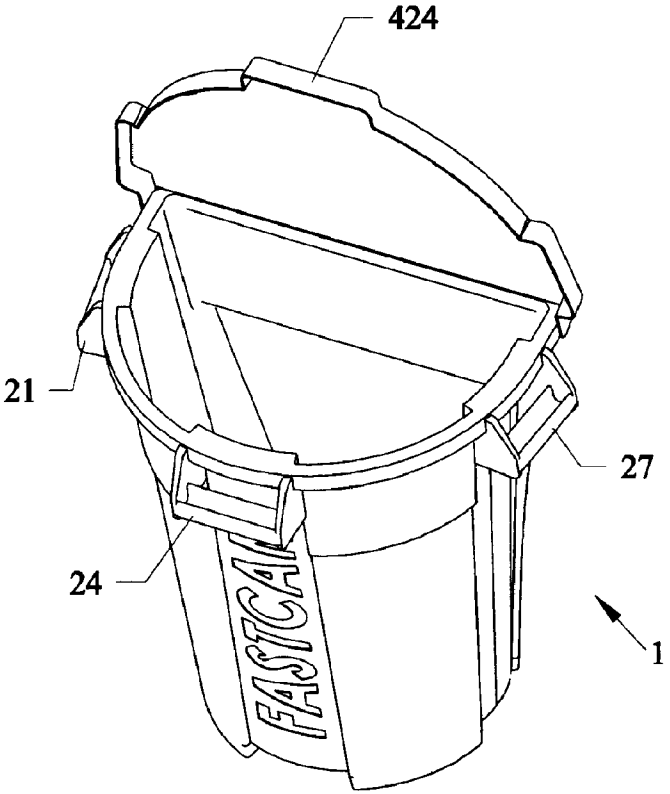
FIG. 21B is another view of FIG. 20A with the hinge lid in an open position.
Figure 21A:
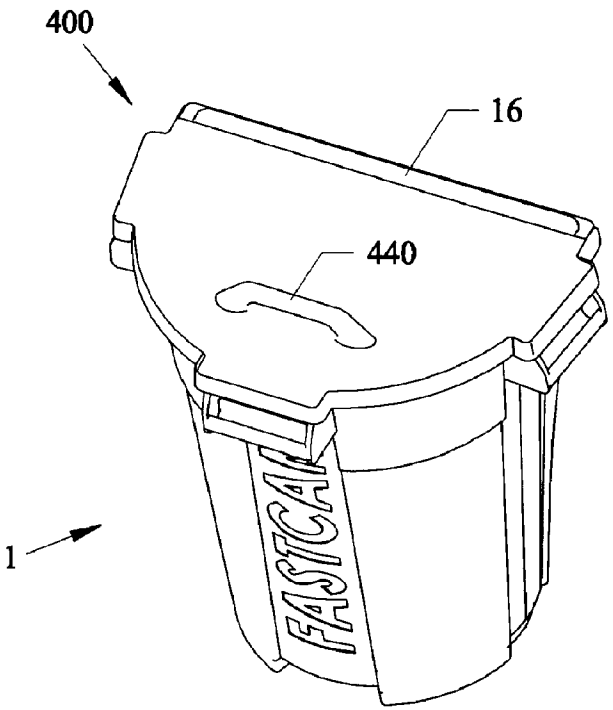
FIG. 21A is a front upper right perspective view of the hinge lid of FIGS. 19A-19B, 20 in a closed position on the novel container.

FIG. 19A is a top perspective view of a hinge lid 400 for use with the container embodiments of the preceding figures. FIG. 19B is a bottom perspective view of the hinge lid 400 of FIG. 19A. FIG. 20 is a perspective view of the novel lid 400 of FIGS. 19A-19B being attached to the novel container of the preceding embodiments. FIG. 21A is a front upper right perspective view of the hinge lid 400 of FIGS. 19A-19B, 20 in a closed position on the novel container. FIG. 21B is another view of FIG. 20A with the hinge lid 400 in an open position.

Referring to FIGS. 19A-21B, a lid 400 can be formed from injection molded or thermo formed plastic and have a flat top cover portion 415 having a substantially D-shape with a handle 440 molded on an upper surface adjacent to an apex portion of the D-shape. Outer extending portions 421, 424, 427 can extend out from the D-shaped edges of the lid 400 for fitting over like positioned handles 21, 24, 27 on the container 1. A curved hanging lip edge 420 on the lid 400 allows the lid 400 to cover the open mouth end 10 of the container 1. Inwardly facing protruding tips 432, 438 on opposite sides of the flat edge 410 of the lid can fit and snap into mateable holes 11 on the mouth end 10 of the container 1. Once attached, a user can raise or lower the lid 400 to open or close the open end of the container 1 by raising the handle 440 which then allows the lid to pivot to the container by hinged connection points formed by protrusions 432, 438 attached to outer edges of the mouth end 10 of the container 1.

Figure 23:
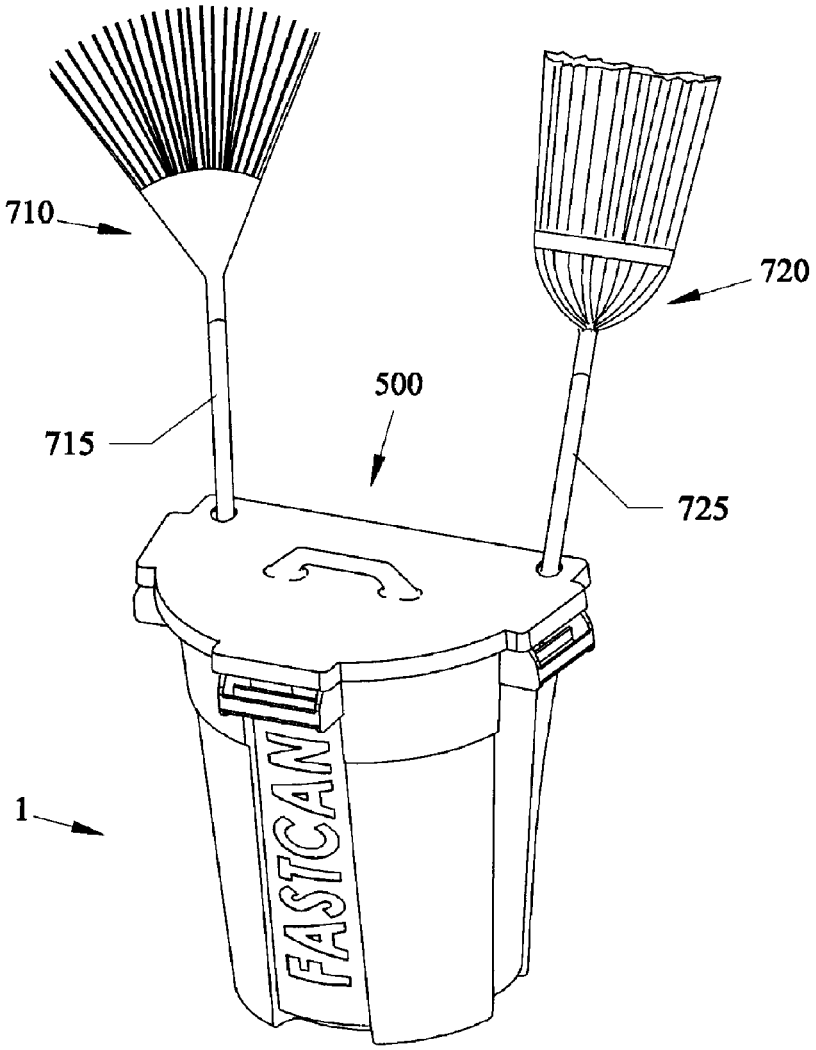
FIG. 23 is a front upper perspective view of the lid with openings of FIGS. 22A-22B in a closed position about one of the novel containers of the preceding embodiments supporting tools such as rakes and shovels.

FIG. 22A is a top perspective view of a novel snap lid 500 with openings 553, 555 for supporting the handles 715, 725 of implements 710, 720 such as brooms, rakes and shovels. FIG. 22B is a bottom perspective view of the lid 500 with openings 553, 555 of FIG. 22A. FIG. 23 is a front upper perspective view of the lid 500 with openings 553, 555 of FIGS. 22A-22B in a closed position about one of the novel containers 1 of the preceding embodiments supporting the longitudinal handles 715, 725 of tools 710, 720 such as rakes 710 and brooms 720. The lid 500 can have a substantially D-shape with a handle 540 molded on an upper surface adjacent to an apex portion of the D-shape. Outer extending portions 521, 524, 527 can extend out from the D-shaped edges of the lid 500 for fitting over like positioned handles 21, 24, 27 on the container 1. A curved hanging lip edge 520 on the lid 500 allows the lid 500 to cover the open mouth end 10 of the container 1. Inwardly facing protruding ridge portions 531, 533, 535, 537 on the inner facing surface of lip 520 of the lid 500 can allow the lid 500 to fit and snap about mateable indentations on mouth end 10 of the container 1.

Figure 24:
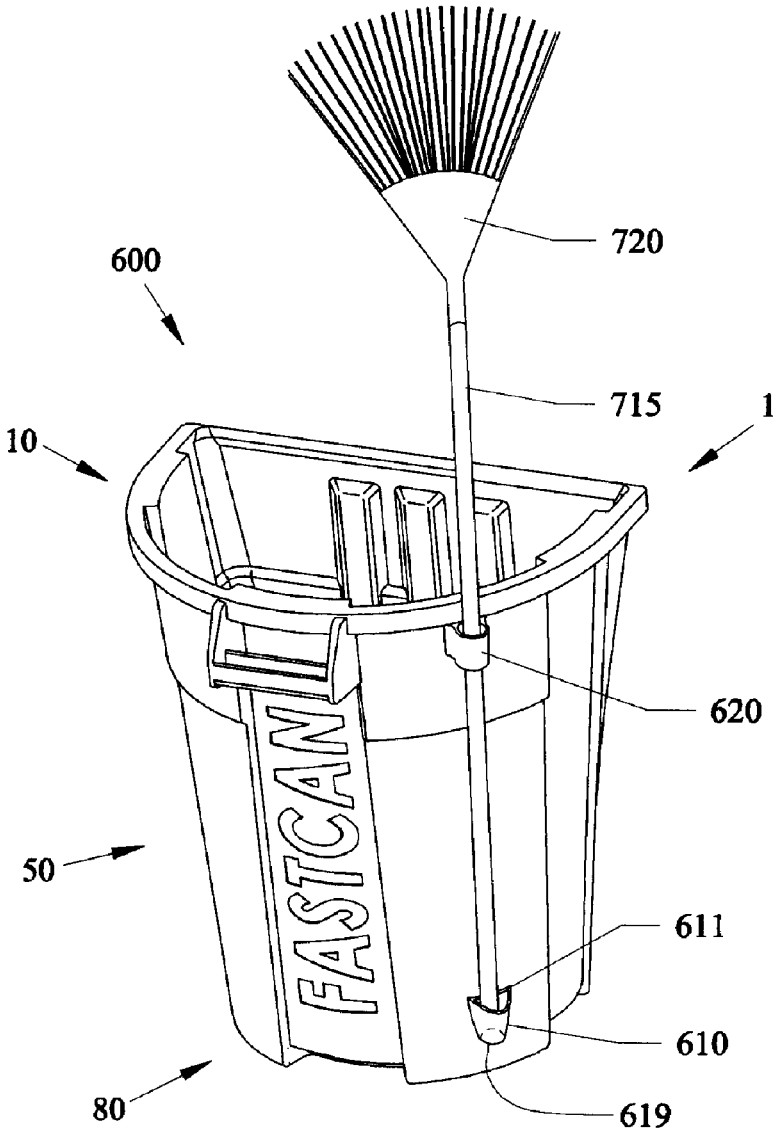
FIG. 24 is another embodiment showing molded side support members on the novel container of the preceding embodiment for supporting long handled tools such as rakes and shovels therein.

FIG. 24 is another embodiment 600 showing molded side support members 620, 610 on the novel container 1 of the preceding embodiment for supporting long handled tools 720 such as rakes, brooms and shovels therein. An upper support member 620 molded onto the side of the container 1 can have a through-hole therethrough for allowing the long handle 715 of the implement to slide therethrough. A lower support member 610 adjacent to the bottom end 80 of the container 1 can be funnel shaped with a larger top opening 611 than a bottom opening 619 so that water can drain through the holder 610 but still support and hold a tip end of a longitudinal handle 715 inside the holder 610. The holders 610 and 620 can allow for tools to be held close to and parallel to the sides of the container 1 so that users can move both the container 1 and the implements 720 together to work sites.

While long handle tools are shown being held and supported in the preceding figures, the invention can be used to hold and support smaller tools such as but not limited to hand shovels, and the like.

Although the container embodiments can be directly filled with debris, the containers can also be lined with removable plastic type garbage bags that can be separately removed as desired from the containers.

Bag tabs can be incorporated along the lower and outer portion of the containers double wall rim/lip at the container opening. The bag tags can allow the user to secure and utilize lawn bags so as to prevent the bag from collapsing and falling into the container while debris is swept into the container that is lying in a horizontal position. The bag tags can also allow for maintaining the open end position of the bags while the container is being raised from a horizontal position to a vertical position, and is able to keep the bag securely in place while placing debris into the container while in an upright position.

Reinforced Dust Pan Adapter

800. Reinforced Dust Pan
810. Generally rectangular upper flap
811. connecting portion
812. outwardly curving portion
815. curved apex
816. inwardly curving outer portion
817. exposed edge of upper flap
820. Generally rectangular lower flap having a generally convex surface
821. connecting portion
822. outwardly sloped flat planar portion
823. angled apex
824. inwardly sloped flat planar portion
825. bent portion
826. inwardly bent hook end
827. exposed edge of lower flap
830. Ramp member
832. thickened (reinforced portion of ramp member)
834. rounded blunt tip
850. D-shaped refuse container
860. flat upper generally rectangular upper rim
862. outer step edge of rim
880. rectangular refuse receptacle
882. first side upper flat rectangular rim (with outer step edge)
884. second side upper flat rectangular rim (with outer step edge)
890. cylindrical receptacle
892. circular rim with rectangular cross-section
894. flattened portion of rim
800A short length reinforced dust pan FIG. 25 is a perspective view of a preferred reinforced dust pan adapter 800. FIG. 26 is a side cross-sectional view of the dust pan 800 of FIG. 25. Referring to FIGS. 25-26, dust pan adapter 800 can include a generally rectangular upper flap 810 and a generally rectangular lower flap 820 with a ramp member 830, which together form a dust pan 800 having a generally C cross-sectional shape.

Viewed from above, the upper flap 810 can have a generally rectangular appearance. Upper flap 810 can have a generally convex smooth curved surface between a connecting portion 811, an outwardly curving portion 812, a curved apex 815, and an inwardly curving outer portion 816 with an exposed edge 817.

Viewed from below, the lower flap 820 can have a generally rectangular appearance. Lower flap 820 can have a generally convex surface between a connecting portion 821, an outwardly sloped flat planar portion 822, an angled apex 823, an inwardly sloped flat planar portion 824, a bent edge portion 825, inwardly bending hook end 826 with an exposed edge 827.

A ramp tip member 830 is formed between the connecting portion 811 of the upper flap 810 and the connecting portion of the lower flap 820. The ramp member can have a blunt rounded tip 834 and a generally triangular thickened portion 832 between the tip 834 and the upper flap connecting portion 811 and lower flap connecting portion 821.

The dust pan adapter 800 can be formed from plastic, fiberglass, compositions thereof, and the like. The dust pan adapter can have a length of approximately 6 to approximately 24 inches from side to side, and a width of approximately ½ inch to approximately 6 inches between the ramp tip and the exposed edges of the upper and the lower flaps. The thickness of the flaps can be approximately 1/10 of an inch up to approximately ¼ of an inch, preferably approximately 1/10 of an inch for many applications. The thickness of the ramp member can be approximately double or more the thickness of the flaps 810 and 820.

For a 13 gallon receptacle a dust pan adapter can have a length of approximately 10 inches. For 30, 40, 45 and 48 gallon container D shaped receptacles having a flat upper side edge having a length of approximately 24 inches, the length of the dust pan adapter 800 can be up to or slightly less than approximately 24 inches. For rectangular containers having upper flat side edges of approximately 18 inches, the length of the dust pan adapter can be up to or slightly less than approximately 18 inches. For rectangular containers having flat side edges of approximately other lengths, the dust pan adapter can have lengths of up to or slightly less than those same lengths.

Figure 27:
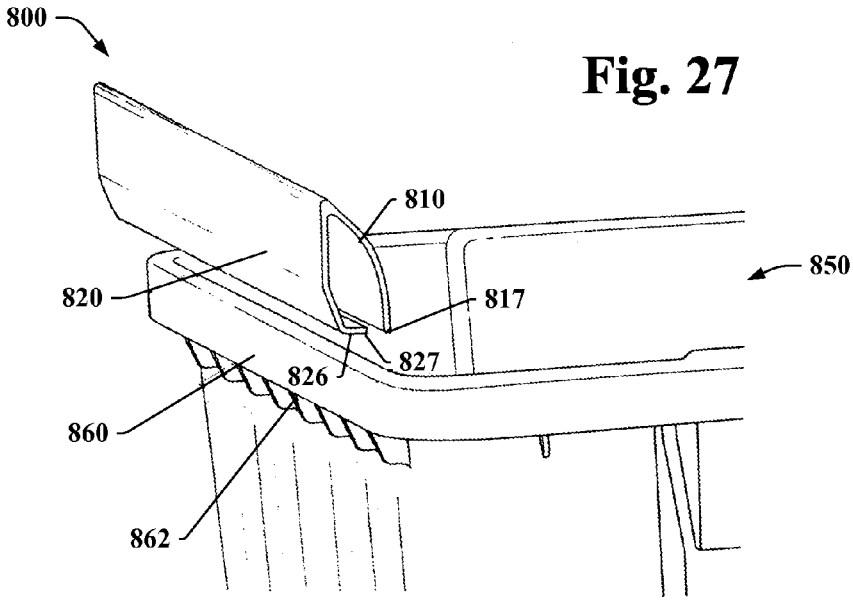
FIG. 27 is an exploded enlarged perspective view of the novel dust pan adapter about to be attached to a flat side edge of a D-shaped refuse container.
Figure 28:
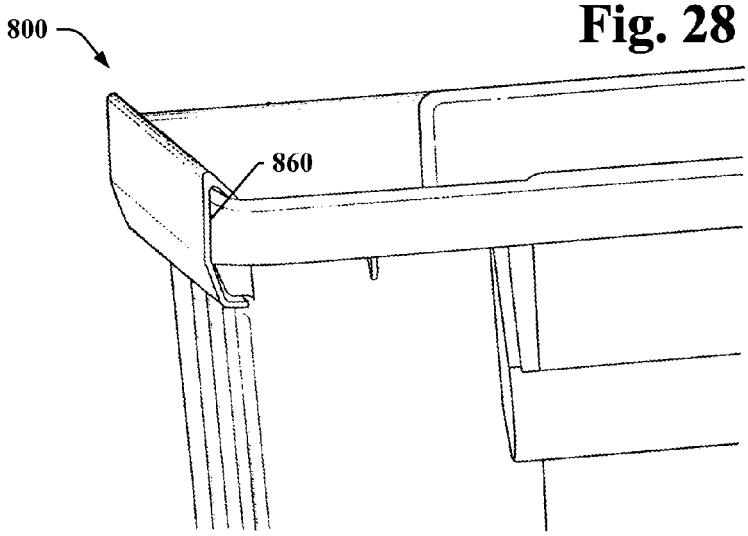
FIG. 28 shows the dust pan adapter attached to the D-shaped refuse container of FIG. 27.
Figure 29:
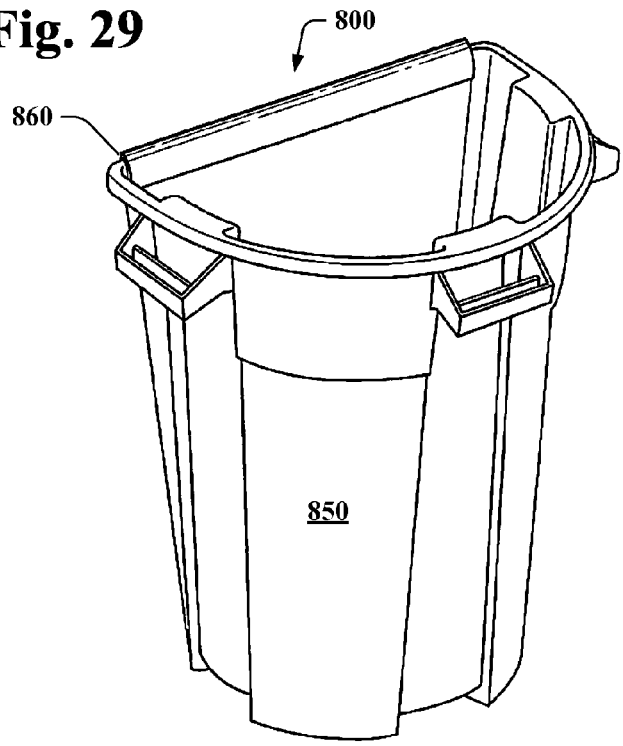
FIG. 29 is another perspective view of the entire D-shaped refuse container with attached dust pan adapter of FIG. 28.

FIG. 27 is an exploded enlarged perspective view of the novel dust pan adapter 800 about to be attached to a flat side edge 860 of a D-shaped refuse container 850. The open end between exposed edges 827, 817 can separate to snap over a flat upper generally rectangular rim 860 of a D-shaped refuse container 850 such as those previously described. Here, the upper flap 810 can be positioned to be place inside the rim 860 of the container 850 with the lower flap 820 to be outside of the rim 860. The inwardly bent hook end 826 can snap about the lower outer step edge 862 of the rim 860 to lock the dust pan adapter 860 in place. FIG. 28 shows the dust pan adapter 800 attached to the D-shaped refuse container 850 of FIG. 27. FIG. 29 is another perspective view of the entire D-shaped refuse container 850 with attached dust pan adapter 800 of FIG. 28.

Figure 30:
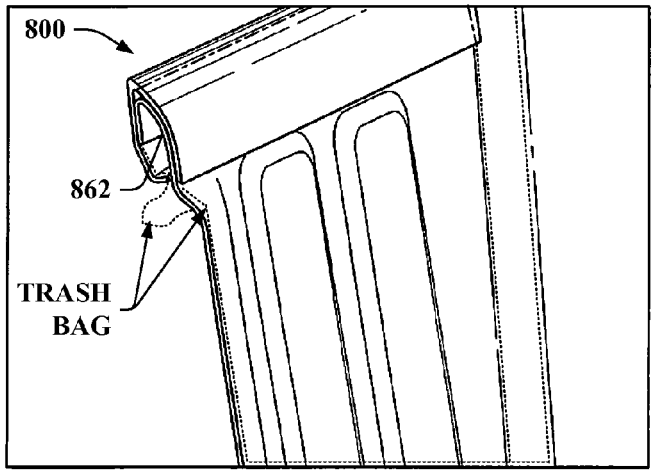
FIG. 30 is an enlarged partial cross-sectional view of the dust pan adapter attached to the refuse container of FIG. 29.

FIG. 30 is an enlarged partial cross-sectional view of the dust pan adapter 800 attached to the refuse container 800 of FIG. 29. As shown in FIG. 30 the inside of the dust pan adapter 800 can conform to tightly wrap bout the rim 860 and lower step edge 862 of the rim 860 to secure the dust pan adapter in place. Next, the container 850 can be placed on its side as depicted in previous figures so that a user can sweep refuse into the container 850 by the smooth sloping upper flap 810 and ramp member 830. When the receptacle 850 is laid on its flat side, the ramp 830, and especially ramp tip 834 is angled down into the floor surface and can hang slightly below the rim 860 of the container 850 allowing for an easier sweep of refuse operation into the inside of the container.

Additionally, the novel dust pan adapter 800 can be used with a trash bag, where an outer edge of the trash bag can be partially or completely wrapped about the rim 860 so that this portion of a trash bag can be sandwiched between the inside of the C cross-sectional shape of the dust pan adapter 800. The overlapping use can be used with or without bag tabs formed in along the side rims of the container.

Figure 31:
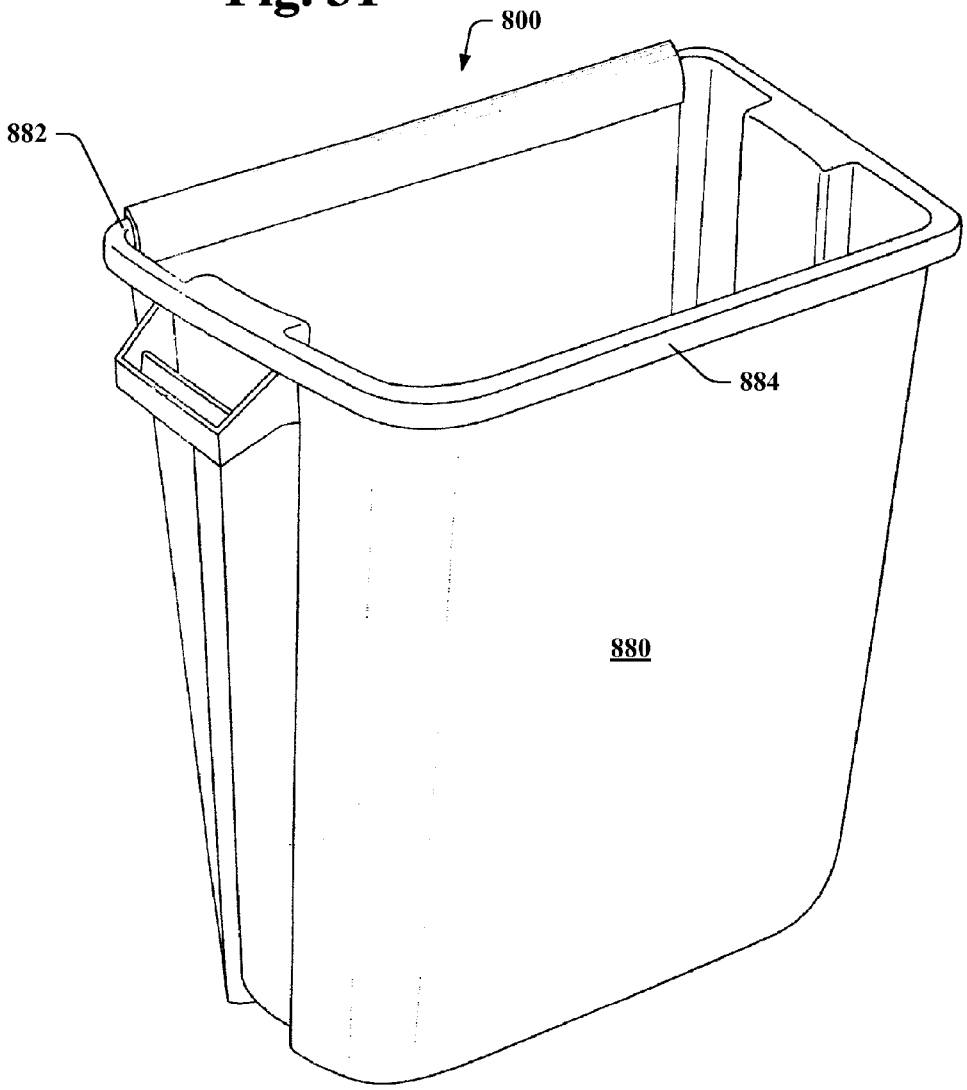
FIG. 31 is a perspective view of the novel snapable dust pan adapter attached to a flat outer side edge of a rectangular container.

FIG. 31 is a perspective view of the novel snapable dust pan adapter 800 attached to a flat outer side edge 882 of a rectangular container 880. Here, the dust pan adapter 800 can be attached similarly to that shown in the previous drawings.

Figure 32:
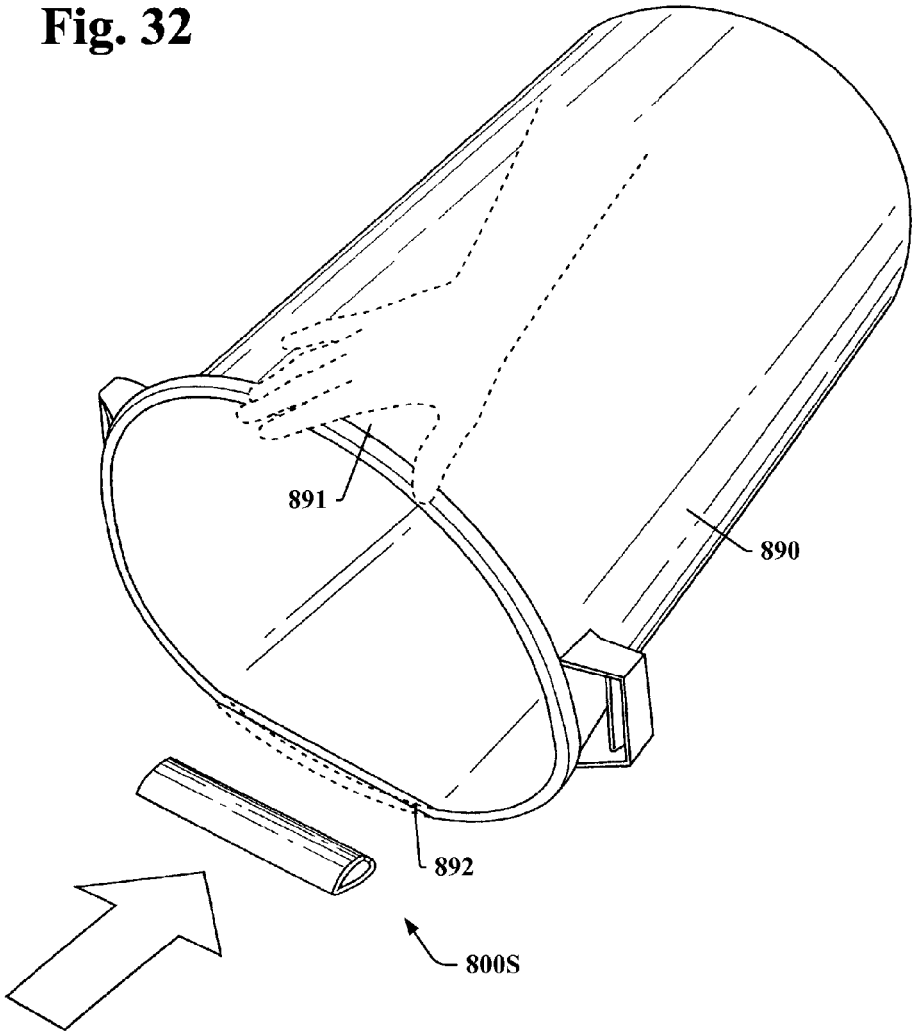
FIG. 32 is a perspective exploded view of a short dust pan adapter about to be attached to a flattened side edge of a cylindrical container.
Figure 33:
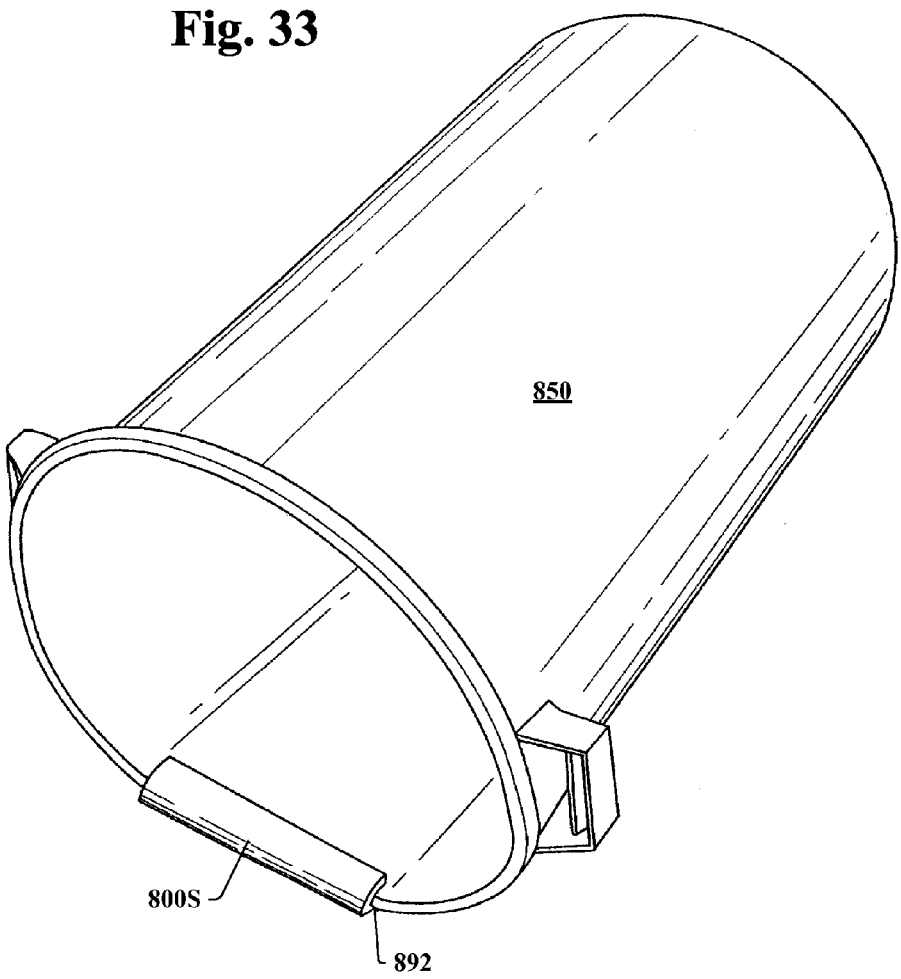
FIG. 33 shows the dust pan adapter attached to the flattened side edge of the cylindrical container of FIG. 32.

FIG. 32 is a perspective exploded view of a short dust pan 800S about to be attached to a flattened side edge 892 of a cylindrical container 890. A plastic and generally pliable cylindrical refuse receptacle 890 can be laid on its side, and pushed down from an upper edge 891 so that a ground engaging upper edge 892 is slightly flattened. Next, the novel dust pan adapter 800S can be slid over and snapped into place similar to the assembly steps described above. FIG. 33 shows the dust pan adapter 800 attached to the flattened side rim edge 892 of the cylindrical container 890 of FIG. 32.

The novel dust pan adapter 800S can be a smaller version such one being approximately 5 to approximately 8 inches, preferably six inches, which can fit over the flattened rim portion 892 of a 30, 40, 45 or 48 gallon refuse container. The dust pan adapter 800S can be strong enough that the flattened edge is kept in a flattened state after the hand is removed. Next, refuse can easily be swept into the container with brooms, brushes and the like. Similarly, trash bags can be used or not used with the cylindrical container as previously described.

The novel reinforced dust pans can be sold separately and be made in different sizes to allow for use with small refuse receptacles up to 13 gallon, 30 gallon, 40, 45 or 48 gallon or more sized receptacles.

The novel reinforced dust pans can be sold as a kit part with existing receptacles if different sizes, and the like. The refuse container can be a semi tubular configuration, such as having a D shape. The refuse container can be rectangular. The refuse container can also be cylindrical with pliable bendable side walls that can be pressed as described above to have a partial flat edge. The dust pan can be easily pulled off while the container is in an upright position, so that a regular shaped lid can snap on the exposed opening to the receptacle. The novel dust pans can be stored inside of the refuse containers when not being used in upright positions that take up little space inside of the receptacles. A trash bag can still fit inside of the receptacle, so that a stored dust pan can be easily located in a side space between a trash bag and an inner wall of the refuse container. Since the dust pan has no handles, and is narrow in thickness, it would take up little room and would not tend to rip into a trash bag in inside of the container.

Although the preferred embodiment is described as being made from reinforced plastic, the novel dust pan can be formed from other materials, such as fiberglass, metals, such as but not limited to aluminum, galvanized metal, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A dust pan usable in relation to a refuse container, comprising:

an upper flap comprising an upper-flap connecting portion and an upper-flap exposed edge, wherein the upper flap comprises a generally convex outer surface;

a lower flap comprising a lower-flap connecting portion and a lower-flap exposed edge; and a ramp tip formed from a connection of the upper-flap connecting portion to the lower-flap connecting portion, wherein the upper flap and the lower flap are adapted to be attachable to a rim at an open end of a refuse container.

2. The dust pan of claim 1, wherein a length of the upper flap is based at least in part on a length of the rim of the refuse container.

3. The dust pan of claim 1, wherein the upper flap and the lower flap are configured to facilitate retaining a portion of a waste bag between the dust pan and the rim of the refuse container when the portion of the waste bag is placed between the dust pan and the rim while the dust pan is attached to the rim.

4. The dust pan of claim 1, wherein the upper flap and the lower flap are structured in relation to each other to form an open end between the upper-flap exposed edge and the lower-flap exposed edge.

5. The dust pan of claim 4, wherein the upper-flap exposed edge and the lower-flap exposed edge are separable from each other to enable the dust pan to be snapped over the rim of the refuse container and attached to the refuse container.

6. The dust pan of claim 4, wherein, when the dust pan is attached to the refuse container, a portion of the upper flap is positioned against an inside surface of a wall of the refuse container associated with the rim of the refuse container, and a portion of the lower flap is positioned to be on an outside surface of the refuse container in proximity to the rim of the refuse container.

7. The dust pan of claim 1, wherein the lower flap has a generally flat portion extending outward from the lower-flap connecting portion to an inclining flat portion that extends to a bent portion, the dust pan configured to be attachable to and detachable from the rim of the refuse container to facilitate laying the refuse container on a side of the refuse container having the rim to facilitate enabling refuse to be deposited into the open end of the refuse container.

8. The dust pan of claim 1, wherein the ramp tip comprises a blunt tip, wherein at least a portion of the blunt tip has a greater thickness than a thickness of at least one of the upper flap or the lower flap.

9. The dust pan of claim 1, wherein the dust pan comprises a generally rectangular configuration having a length that is longer than its width.

10. The dust pan of claim 1, wherein a combination of the upper flap and the lower flap is configured to form a generally C cross-sectional shape.

11. The dust pan of claim 1, wherein at least one of the upper flap, the lower flap, or the ramp tip are formed from at least one of plastic, fiberglass, or metal.

12. A refuse receptacle, comprising:

a refuse container comprising a closed end having a defined shape, and a set of walls of defined length extending from the closed end to an open end of the refuse container, wherein the set of walls comprises a wall having a generally flat side wall portion and the open end having a generally flat side edge associated with the generally flat side wall portion; and a dust pan having a generally rectangular configuration, wherein an open end of the dust pan forms a clip, and a closed end of the dust pan forms a ramp edge, the clip usable to snap the open end of the clip about the generally flat side edge of the refuse container to attach the dust pan to the refuse container, and wherein the dustpan comprises an upper flap having a generally convex surface between a connecting portion of the upper flap and an upper-flap exposed edge, and a lower flap that is associated with the upper flap at the closed end of the dust pan to form the ramp edge.

13. The refuse receptacle of claim 12, wherein the refuse container comprises a semi-tubular container comprising the closed end having a substantially circular configuration and the open end having a substantially D-shaped configuration, the set of walls comprising substantially rounded side walls having a non-rectangular shape and the generally flat side wall portion.

14. The refuse receptacle of claim 12, wherein the refuse container comprises a generally rectangular container comprising the closed end having a generally rectangular configuration and the open end having a generally rectangular configuration, and the set of walls comprising generally flat walls extending between the closed end and the open end.

15. The refuse receptacle of claim 12, wherein the lower flap having a generally convex surface between a connecting portion of the lower flap and a lower-flap exposed edge, and the ramp edge is formed between the connecting portion of the upper flap and the connecting portion of the lower flap, wherein the upper flap and the lower flap are configured in relation to each other to form the open end of the dust pan between the upper-flap exposed edge and the lower-flap exposed edge.

16. The refuse receptacle of claim 15, wherein the upper-flap exposed edge and the lower-flap exposed edge are separable from each other to enable the dust pan to be snapped over the generally flat side edge of the refuse container and attached to the refuse container.

17. The refuse receptacle of claim 15, wherein the generally convex surface of the upper flap comprises a curved convex outer surface, and the lower flap has a generally flat portion that extends outward from the connecting portion of the lower flap to an inclining flat portion, the inclining flat portion extends to a bent exposed edge, the dust pan being attachable to the generally flat side edge of the refuse container to facilitate allowing the refuse container to be laid on its side to facilitate depositing of refuse into the refuse container via the dust pan.

18. The refuse receptacle of claim 15, wherein the ramp edge includes a blunt narrow tip, and at least a portion of the ramp edge has a greater thickness than a thickness of at least one of the upper flap or the lower flap.

19. The refuse receptacle of claim 15, wherein a combination of the upper flap and the lower flap are configured to form a generally C cross-sectional shape.

20. A method for forming a dust pan, comprising:

forming an upper flap comprising an upper-flap connecting portion and an upper-flap exposed edge, wherein the upper flap comprises a generally convex outer surface;

forming a lower flap comprising a lower-flap connecting portion and a lower-flap exposed edge; and forming a ramp edge of the dust pan, wherein the ramp edge is formed from a connection of the upper-flap connecting portion with the lower-flap connecting portion, and wherein the upper flap and the lower flap are configured to be attachable to a rim at an open end of a refuse container.

* * * * *